US008866807B2

(12) United States Patent
Kato

(10) Patent No.: US 8,866,807 B2
(45) Date of Patent: Oct. 21, 2014

(54) DISPLAY DEVICE AND METHOD OF DRIVING THE SAME

(75) Inventor: Toshiyuki Kato, Osaka (JP)

(73) Assignee: Panasonic Corporation, Osaka (JP)

( * ) Notice: Subject to any disclaimer, the term of this patent is extended or adjusted under 35 U.S.C. 154(b) by 186 days.

(21) Appl. No.: 13/596,710

(22) Filed: Aug. 28, 2012

(65) Prior Publication Data

US 2012/0327066 A1 Dec. 27, 2012

Related U.S. Application Data

(63) Continuation of application No. PCT/JP2011/004688, filed on Aug. 24, 2011.

(30) Foreign Application Priority Data

Dec. 10, 2010 (JP) ..... 2010-276440

(51) Int. Cl.
*G09G 3/32* (2006.01)

(52) U.S. Cl.
CPC ..... *G09G 3/3225* (2013.01); *G09G 2330/021* (2013.01); *G09G 2360/16* (2013.01); *G09G 2320/0223* (2013.01); *G09G 2330/028* (2013.01); *G09G 2320/029* (2013.01)
USPC ..... 345/212; 345/208

(58) Field of Classification Search
CPC ..... G09G 3/3225; G09G 2320/0223; G09G 2320/029; G09G 2330/021; G09G 2330/028; G09G 2360/16
USPC ..... 345/208, 212; 713/300–340
See application file for complete search history.

(56) References Cited

U.S. PATENT DOCUMENTS

| | | | |
|---|---|---|---|
| 6,710,548 | B2 | 3/2004 | Kimura |
| 7,652,664 | B2 | 1/2010 | Iwabuchi et al. |
| 7,952,379 | B2 | 5/2011 | Kwak |
| 7,960,917 | B2 | 6/2011 | Kimura |
| 8,115,758 | B2 | 2/2012 | Iwabuchi et al. |
| 2002/0105279 | A1 | 8/2002 | Kimura |
| 2004/0263444 | A1 | 12/2004 | Kimura |

(Continued)

FOREIGN PATENT DOCUMENTS

| | | | |
|---|---|---|---|
| JP | 2002-311898 | A | 10/2002 |
| JP | 2006-065148 | A | 3/2006 |

(Continued)

OTHER PUBLICATIONS

International Search Report issued in International Patent Application No. PCT/JP2011/004688 dated Nov. 22, 2011.

*Primary Examiner* — Joe H Cheng
*Assistant Examiner* — Lisa Landis
(74) *Attorney, Agent, or Firm* — McDermott Will & Emery LLP

(57) ABSTRACT

A display device includes an organic EL display unit including plural pixels, a variable-voltage source which supplies a positive electrode supply potential and a negative electrode supply potential to the display organic EL display unit, and an arithmetic circuit which measures an anode potential and a cathode potential of a representative pixel. The variable-voltage source regulates the positive electrode supply potential with respect to the negative electrode supply potential, according to at least the potential difference between the negative electrode supply potential of the variable-voltage source and the cathode potential of the representative pixel, and supply the regulated positive electrode supply potential to the organic EL display unit.

13 Claims, 20 Drawing Sheets

(56) References Cited

U.S. PATENT DOCUMENTS

| | | | | |
|---|---|---|---|---|
| 2006/0038758 | A1 | 2/2006 | Routley et al. | |
| 2008/0100227 | A1 | 5/2008 | Iwabuchi et al. | |
| 2008/0169822 | A1 | 7/2008 | Kwak | |
| 2008/0266216 | A1 * | 10/2008 | Choi | 345/77 |
| 2008/0284688 | A1 | 11/2008 | Marx et al. | |
| 2010/0103203 | A1 | 4/2010 | Choi | |
| 2010/0164938 | A1 | 7/2010 | Iwabuchi et al. | |
| 2011/0298396 | A1 | 12/2011 | Kimura | |

FOREIGN PATENT DOCUMENTS

| | | | |
|---|---|---|---|
| JP | 2006-178429 | A | 7/2006 |
| JP | 2008-502015 | A | 1/2008 |
| JP | 2008-170941 | A | 7/2008 |
| JP | 2008-268914 | A | 11/2008 |
| JP | 2009-162980 | A | 7/2009 |
| WO | WO-2005/122120 | A2 | 12/2005 |
| WO | WO-2006/057321 | A1 | 6/2006 |

* cited by examiner

| Video data (Gradation level) | Required voltage (RED) | Required voltage (Green) | Required voltage (Blue) |
|---|---|---|---|
| 0 | 4 | 4.2 | 3.5 |
| 1 | 4.1 | 4.3 | 3.5 |
| 2 | 4.1 | 4.4 | 3.6 |
| 3 | 4.2 | 4.5 | 3.6 |
| ⋮ | ⋮ | ⋮ | ⋮ |
| 176 | 8.3 | 9.6 | 6.7 |
| 177 | 8.5 | 9.9 | 6.9 |
| ⋮ | ⋮ | ⋮ | ⋮ |
| 253 | 10.5 | 11.4 | 8.2 |
| 254 | 10.8 | 11.8 | 8.3 |
| 255 | 11.2 | 12.2 | 8.4 |

DISPLAY DEVICE AND METHOD OF DRIVING THE SAME

CROSS REFERENCE TO RELATED APPLICATIONS

This is a continuation application of PCT Patent Application No. PCT/JP2011/004688 filed on Aug. 24, 2011, designating the United States of America, which is based on and claims priority of Japanese Patent Application No. 2010-276440 filed on Dec. 10, 2010. The entire disclosures of the above-identified applications, including the specifications, drawings and claims are incorporated herein by reference in their entirety.

TECHNICAL FIELD

The present disclosure relates generally to active-matrix display devices which use current-driven luminescence elements represented by organic electroluminescence (EL) elements and to driving methods thereof, and relate more particularly to a display device having excellent power consumption reducing effect and to a driving method thereof.

BACKGROUND ART

In general, the luminance of an organic electroluminescence (EL) element is dependent upon the drive current supplied to the element, and the luminance of the luminescence of the element increases in proportion to the drive current. Therefore, the power consumption of displays made up of organic EL elements is determined by the average of display luminance. Specifically, unlike liquid crystal displays, the power consumption of organic EL displays varies significantly depending on the displayed image.

For example, in an organic EL display, the highest power consumption is required when displaying an all-white image, whereas in the case of a typical natural image, power consumption which is approximately 20 to 40% that for all-white is considered to be sufficient.

However, because power source circuit design and battery capacity entail designing which assumes the case where the power consumption of a display becomes highest, it is necessary to consider power consumption that is 3 to 4 times that for the typical natural image, and thus becoming a hindrance to the lowering of power consumption and the miniaturization of devices.

Consequently, there is conventionally proposed a technique which suppresses power consumption with practically no drop in display luminance, by detecting the peak value of video data and regulating the cathode voltage of the organic EL elements based on such detected data so as to reduce power source voltage (for example, see Patent Literature (PTL) 1).

CITATION LIST

Patent Literature

[PTL 1] Japanese Unexamined Patent Application Publication No. 2006-065148

SUMMARY OF INVENTION

Technical Problem

Now, since an organic EL element is a current-driven element, current flows through a power source wire and a voltage drop which is proportionate to the wire resistance occurs. As such, the power source voltage to be supplied to the display is set by adding a voltage drop margin for compensating for a voltage drop. In the same manner as the previously described power source circuit design and battery capacity, since the power drop margin for compensating for a voltage drop is set assuming the case where the power consumption of the display becomes highest, unnecessary power is consumed for typical natural images.

In a small-sized display intended for mobile device use, panel current is small and thus, compared to the voltage to be consumed by pixels, the power drop margin for compensating for a voltage drop is negligibly small. However, when current increases with the enlargement of panels, the voltage drop occurring in the power source wire no longer becomes negligible.

However, in the conventional technique in the above-mentioned Patent Reference 1, although power consumption in each of the pixels can be reduced, the power drop margin for compensating for a voltage drop cannot be reduced, and thus the power consumption reducing effect for household large-sized display devices of 30-inches and above is insufficient.

The present disclosure was conceived in view of the aforementioned problem and has as an object to provide (i) a low-cost display device that appropriately deals with the variation in luminance between pixels and the change in pixel luminance over time while having excellent power consumption reducing effect and (ii) a driving method thereof.

Solution to Problem

The display device according to an aspect of the present disclosure includes: a display unit including a pixel having an anode electrode and a cathode electrode; a power supplying unit configured to supply a high-side potential and a low-side potential to the display unit; and a voltage measuring unit configured to measure a cathode potential of the pixel, wherein the power supplying unit is configured to regulate the high-side potential with respect to the low-side potential, according to a potential difference between the low-side potential supplied to the display unit and the cathode potential measured by the voltage measuring unit, and supply the regulated high-side potential to the display unit.

According to the above-described configuration, the high-side supply potential of the power supplying unit can be set appropriately by feeding back, to the positive electrode of the power supplying unit, the increase in the cathode potential of the pixel which has risen with respect to the low-side potential supplied from the power supplying unit to the display unit, under the influence of the power source wire. Therefore, even when there is a limit to the range of the supply potential of the negative electrode of the power supplying unit, the appropriate voltage to be applied from the power supplying unit to the pixel, which takes into consideration the potential distribution inside the display unit, can be set by regulating the potential of the positive electrode relative to the negative electrode, and thus it is possible to realize a display device that appropriately deals with the variation in luminance between pixels and the change in pixel luminance over time while having excellent power consumption reducing effect.

When the power supplying unit is configured of a DC-to-DC converter, the potential difference between the negative electrode terminal and the negative electrode-side output detecting terminal is generally limited, for purposes of use, so as to be within a predetermined voltage. The voltage limit is often 1 V or less and, in a large-sized display panel, the case where the potential difference between the negative potential supplied by the power supplying unit and the cathode potential applied to the pixel exceeds the voltage limit is assumed. In this case, the aforementioned potential difference is not accurately fed back to the power supplying unit, and thus it becomes difficult to set an appropriate supply voltage for the power supplying unit which reflects the rise in the cathode potential applied to the pixel. Furthermore, setting the aforementioned voltage limit sufficiently high brings about the problem that the cost of the power supplying unit increases. In view of this, by feeding back the amount by which the cathode potential applied to the pixel has risen with respect to the negative potential supplied from the power supplying unit to the display unit, not to the negative electrode but to the positive electrode of the power supplying unit, the luminance variation due to the cathode potential rise occurring in the power source wire can be reduced using the already-existing power supplying unit.

Furthermore, the display unit may include a plurality of pixels each of which is the pixel, the voltage measuring unit may be configured to measure a cathode potential of at least one representative pixel which is a predetermined one of the pixels, and the power supplying unit may be configured to regulate the high-side potential with respect to the low-side potential, according to at least a potential difference between the low-side potential supplied by the power supplying unit to the display unit and the cathode potential of the at least one representative pixel measured by the voltage measuring unit, and supply the regulated high-side potential to the display unit.

With this, the present disclosure can be applied even when the display unit has, for example, a configuration in which pixels are arranged in rows and columns. Specifically, the high-side supply potential of the power supplying unit can be set appropriately by feeding back, to the positive electrode of the power supplying unit, the increase in the cathode potential of the representative pixel which has risen with respect to the low-side potential supplied from the power supplying unit to the display unit, under the influence of the power source wire. Therefore, even when there is a limit to the range of the supply potential of the negative electrode of power supplying unit, the appropriate voltage to be applied from the power supplying unit to the pixel, which takes into consideration the potential distribution inside the display unit, can be set by regulating the potential of the positive electrode relative to the negative electrode, and thus it is possible to realize a display device that appropriately deals with the variation in luminance between pixels and the change in pixel luminance over time while having excellent power consumption reducing effect.

Furthermore, for example, the voltage measuring unit is configured to measure an anode potential and the cathode potential of the at least one representative pixel, and the power supplying unit is configured to regulate the high-side potential with respect to the low-side potential, according to the anode potential and the potential difference between the low-side potential and the cathode potential, and supply the regulated high-side potential to the display unit.

Accordingly, by particularly providing a voltage measuring unit which measures both the anode potential and the cathode potential that are applied to the representative pixel, and feeding back, to the positive electrode of the power supplying unit, a voltage drop amount that combines the potential differences generated at the power source wires at both the anode electrode-side and the cathode electrode-side, it is possible to realize control for compensating for the voltage drop occurring at both the anode potential and cathode potential of the pixel despite regulating only the positive electrode potential in the power supplying unit. Therefore, it is possible to set an appropriate power supplying unit supply potential which takes into consideration the potential distribution inside the display unit, and thus it is possible to realize a display device that appropriately deals with the variation in luminance between pixels and the change in pixel luminance over time while having maximum power consumption reducing effect.

Furthermore, for example, the display device further includes an arithmetic circuit that calculates a voltage drop amount in the at least one representative pixel and feeds back the voltage drop amount to the power supplying unit, the voltage drop amount being an absolute value of a value obtained by subtracting the cathode potential corresponding to the low-side potential from the anode potential corresponding to a preset potential in a positive electrode of the power supplying unit, wherein the power supplying unit is configured to raise the high-side potential with respect to the low-side potential by a greater amount as the voltage drop amount is greater, and supply the raised high-side potential to the display unit.

With this, the arithmetic circuit provided upstream of the power supplying unit calculates the voltage drop amount, and the supply potential of the positive electrode of the power supplying unit is regulated according to the size of the voltage drop amount. Specifically, the supply potential of the positive electrode of the power supplying unit is regulated to be higher as the voltage drop amount is large. Therefore, for example, by inputting the output of the arithmetic circuit to the output detecting terminal of the power supplying unit, the power supplying unit only requires a single output detecting terminal, and thus cost can be reduced.

Furthermore, for example, the display device may further include an arithmetic circuit that calculates and outputs a converted potential which is a value obtained by adding-up the low-side potential and the anode potential and subtracting the cathode potential, wherein the power supplying unit may be configured to compare the converted potential outputted from the arithmetic circuit and a preset potential in a positive electrode of the power supplying unit, raise the high-side potential with respect to the low-side potential by a greater amount as the converted potential is lower than the preset potential, and supply the raised high-side potential to the display unit.

With this, a converted potential obtained by subtracting the potential rise of the cathode electrode caused by the power source wire of the cathode electrode of the display unit from the anode potential of the representative pixel is generated and outputted. Since the converted potential becomes a potential obtained by subtracting the absolute value of the amount of voltage drop occurring in the anode power source wire and the absolute value of the amount of voltage drop occurring in the cathode power source wire of the display unit, from the potential that is preset as the positive electrode potential of the power supplying unit, and is fed back to the positive electrode-side output detecting unit, control for compensating for the voltage drop occurring in both the anode electrode and cathode electrode can be implemented in the power supplying unit despite using only the positive electrode-side output detecting unit. Specifically, the supply potential of the positive electrode of the power supplying unit is regulated to be higher as the preset potential is lower than the converted potential. Even in this case, the number of output detecting terminals required by the power supplying unit is reduced to one, thus likewise reducing cost.

Furthermore, the display device may further include: a high-potential monitor wire having one end connected to the at least one representative pixel and an other end connected to the voltage measuring unit, for transmitting the anode potential; and a low-potential monitor wire having one end connected to the at least one representative pixel and an other end connected to the voltage measuring unit, for transmitting the cathode potential.

With this, the voltage measuring unit can measure at least one of (i) the anode potential applied to at least one representative pixel, via a high-potential monitor wire and (ii) the cathode potential applied to the at least one representative pixel, via a low-potential monitor wire.

Furthermore, the display unit may include: two or more representative pixels from which anode potentials are measured, each of the representative pixels being the at least one representative pixel; and two or more representative pixels from which cathode potentials are measured, each of the representative pixels being the at least representative pixel, the voltage measuring unit may include: a smallest value circuit that detects a smallest potential out of two or more anode potentials measured from the two or more representative pixels; and a largest value circuit that detects a largest potential out of two or more cathode potentials measured from the two or more representative pixels, and the arithmetic circuit may calculate the voltage drop amount, using the smallest potential as the anode potential of the at least one representative pixel and the largest potential as the cathode potential of the at least one representative pixel.

Furthermore, the display unit may include: two or more representative pixels from which anode potentials are measured, each of the representative pixels being the at least one representative pixel; and two or more representative pixels from which cathode potentials are measured, each of the representative pixels being the at least one representative pixel, the voltage measuring unit may include: a smallest value circuit that detects a smallest potential out of two or more anode potentials measured from the two or more representative pixels; and a largest value circuit that detects a largest potential out of two or more cathode potentials measured from the two or more representative pixels, and the arithmetic circuit may calculate the converted potential, using the smallest potential as the anode potential of the at least one representative pixel and the largest potential as the cathode potential of the at least one representative pixel.

With this, it is possible to more appropriately regulate the positive electrode supply potential with respect to the negative electrode supply potential of the power supplying unit. Therefore, power consumption can be effectively reduced even when the size of the display unit is increased.

Furthermore, the display unit may include a plurality of representative pixels from which anode potentials and cathode potentials are measured, each of the representative pixels being the at least one representative pixel, the display device may further include a plurality of arithmetic circuits that calculate and output converted potentials for the respective representative pixels, each of the arithmetic circuits being the arithmetic circuit, and the power supplying unit may be configured to compare the preset potential and a smallest converted potential among the converted potentials outputted from the arithmetic circuits, raise the high-side potential with respect to the low-side potential by a greater amount as the smallest converted potential is lower than the preset potential, and output the raised high-side potential to the display unit.

Specifically, in appropriately regulating the positive electrode supply potential of the power supplying unit based on the potential information of the representative pixels, it is acceptable to calculate the converted potential on a per representative pixel basis, calculate a smallest converted potential among the converted potentials, and feed back the calculated smallest converted potential to the power supplying unit. With this, the positive electrode supply potential of the power supplying unit can be more appropriately regulated.

Furthermore, for example, each of the pixels includes a driving element and a luminescence element, the driving element includes a source electrode and a drain electrode, the luminescence element includes a first electrode and a second electrode, the first electrode being connected to one of the source electrode and the drain electrode of the driving element, the anode potential is applied to one of the second electrode and the other of the source electrode and the drain electrode, and the cathode potential is applied to the other of the second electrode and the other of the source electrode and the drain electrode.

Furthermore, for example, the second electrode forms part of a common electrode provided in common to the pixels, the common electrode is electrically connected to the power supplying unit so that a potential is applied to the common electrode from a periphery of the common electrode, and the at least one representative pixel is disposed near a center of the display unit.

Accordingly, since regulating is performed based on the potential difference at the location where the voltage drop amount is normally largest such as near the center of the display unit, the high-side output potential of the power supplying unit can be easily regulated particularly when the size of the display unit is increased.

Furthermore, the second electrode may be made of a transparent conductive material including a metal oxide.

Furthermore, the luminescent element may be an organic electroluminescence (EL) element.

Accordingly, since heat generation can be suppressed through the reduction of power consumption, the deterioration of the organic EL element can be suppressed.

Furthermore, the present disclosure can be implemented, not only as a display device including such characteristic units, but also as display device driving method having the characteristic units included in the display device as steps.

Advantageous Effects of Invention

According to the present disclosure, it is possible to realize a low-cost display device that appropriately deals with the variation in luminance between pixels and the change in pixel luminance over time while having excellent power consumption reducing effect.

BRIEF DESCRIPTION OF DRAWINGS

These and other advantages and features will become apparent from the following description thereof taken in conjunction with the accompanying Drawings, by way of non-limiting examples of embodiments of the present disclosure. In the Drawings.

DESCRIPTION OF EMBODIMENTS

Figure 1:
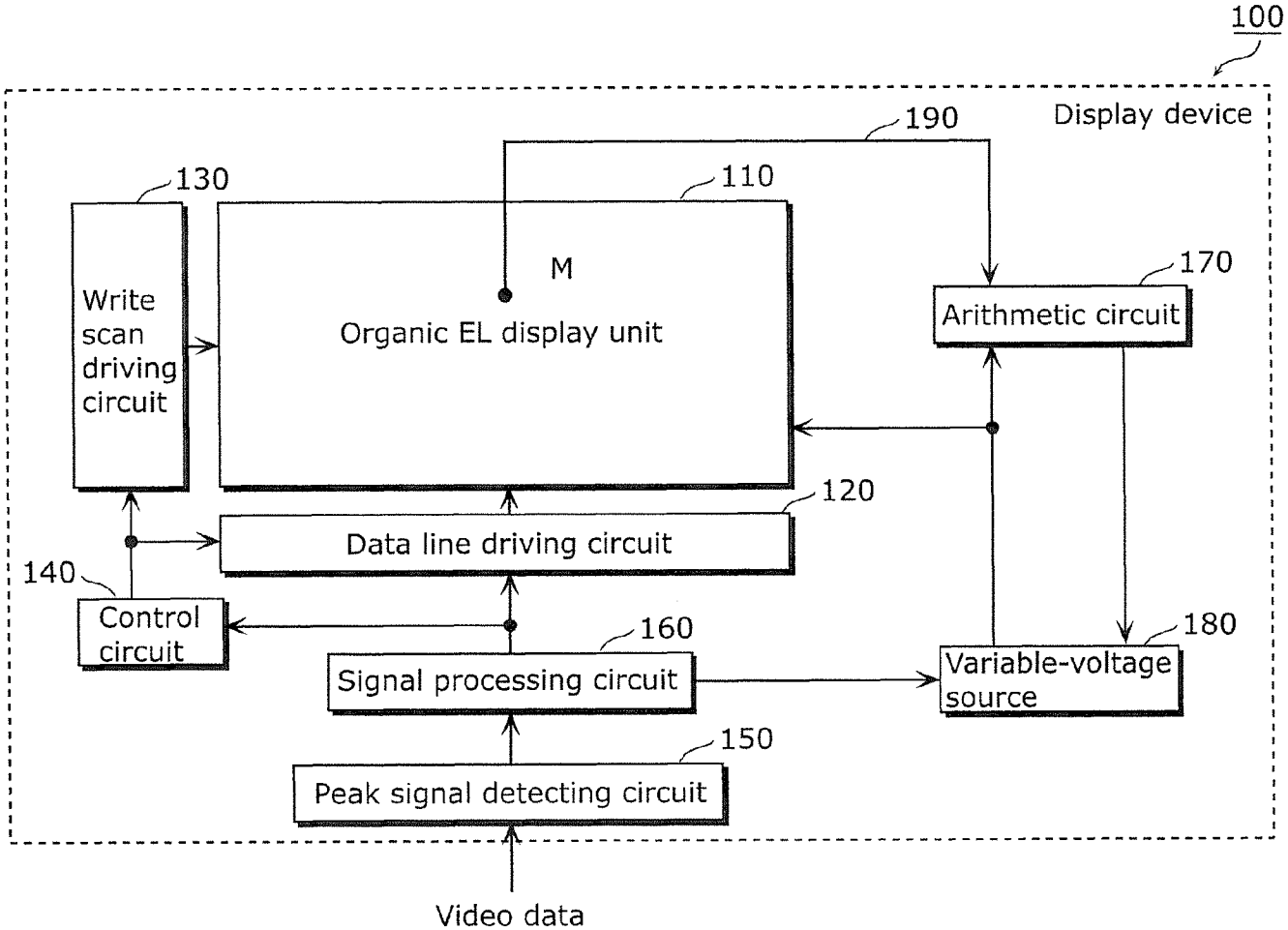
FIG. 1 is a block diagram showing an outline configuration of a display device according to Embodiment 1 of the present disclosure.

Hereinafter, the preferred embodiments of the present disclosure are described with reference to the Drawings. It is to be noted that, in all the figures, the same reference numerals are given to the same or corresponding elements and redundant description thereof shall be omitted.

Embodiment 1

The display device according to the this embodiment, includes: an organic EL display unit including plural pixels each having an anode electrode and a cathode electrode; a variable-voltage source which supplies a high-side potential and a low-side potential to the organic EL display unit; and a voltage measuring unit which measures an anode potential and a cathode potential of a representative pixel which is predetermined from among the plural pixels, wherein the variable-voltage source regulates the high-side potential with respect to the low-side potential, according to (i) a potential difference between the low-side potential supplied to the organic EL display unit and the cathode potential of the representative pixel and (ii) a potential difference between the high-side potential supplied to the organic EL display unit and the anode potential of the representative pixel, and supplies the regulated high-side potential to the organic EL display unit.

With this, control for compensating for the potential drop and potential rise occurring in both the anode electrode and cathode electrode of the pixel can be implemented despite regulating only high-potential-side, that is, the supply potential of the positive electrode in the power supplying unit. Therefore, it is possible to realize a display device that appropriately deals with the variation in luminance between pixels and the change in pixel luminance over time while having excellent power consumption reducing effect.

Hereinafter, Embodiment 1 of the present disclosure shall be specifically described with reference to the Drawings.

FIG. 1 is a block diagram showing an outline configuration of the display device according to Embodiment 1 of the present disclosure. A display device 100 shown in the figure includes an organic electroluminescence (EL) display unit 110, a data line driving circuit 120, a write scan driving circuit 130, a control circuit 140, a peak signal detecting circuit 150, a signal processing circuit 160, an arithmetic circuit 170, a variable-voltage source 180, and a monitor wire 190.

Figure 2:
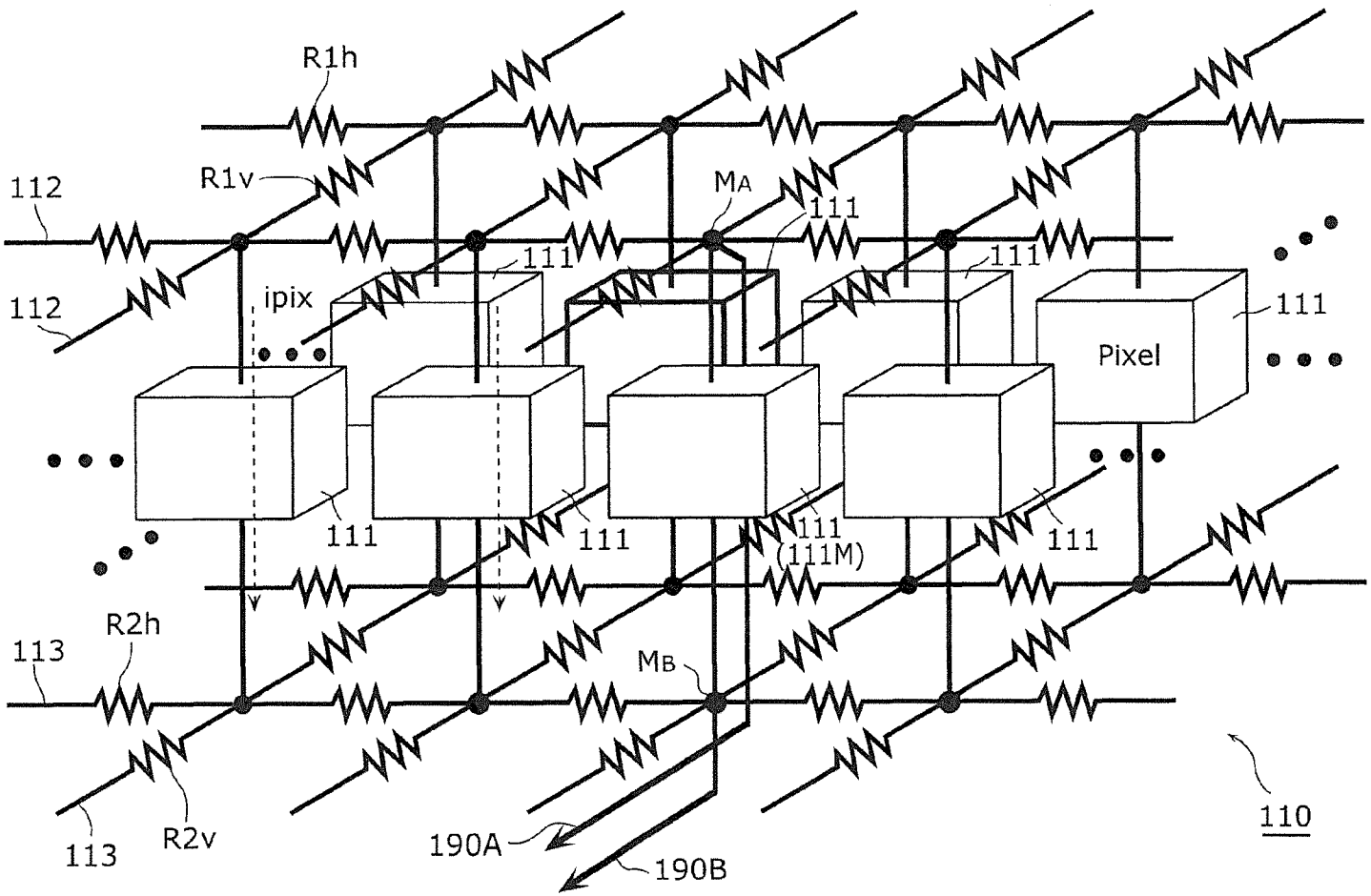
FIG. 2 is a perspective view schematically showing a configuration of an organic EL display unit.

FIG. 2 is a perspective view schematically showing a configuration of an organic EL display unit. It is to be noted that, for example, the lower portion of the figure is the display screen side. As shown in the figure, the organic EL display unit 110 includes pixels 111 that are arranged in rows and columns, a first power source wire 112, and a second power source wire 113.

Each pixel 111 is connected to the first power source wire 112 and the second power source wire 113, and produces luminescence at a luminance that is in accordance with a pixel current $i_{pix}$ that flows to the pixel 111. At least one predetermined representative pixel out of the pixels 111 is connected to monitor wires 190A and 190B at detecting points $M_A$ and $M_B$, respectively. Hereinafter, the pixel 111 that is directly connected to the monitor wires 190A and 190B shall be denoted as a representative pixel 111M for monitoring. Furthermore, the detecting point $M_A$ is defined as the anode electrode of the representative pixel and the detecting point $M_B$ is defined as the cathode electrode of the representative pixel. The representative pixel 111M is located near the center of the organic EL display unit 110. It is to be noted that near the center includes the center and the surrounding parts thereof. Furthermore, a pixel A which is directly connected to the monitor wire 190A and a pixel B which is directly connected to the monitor wire 190B need not necessarily be the same pixel. When the pixel A and the pixel B are located adjacent to each other, or when the pixel A and the pixel B are included in the same predetermined region, the pixel A and the pixel B are defined as predetermined representative pixels.

The first power source wire 112 is arranged in a net-like manner to correspond to the pixels 111 which are arranged in rows and columns. On the other hand, the second power source wire 113 is formed in the form of a continuous film on the organic EL display unit 110. The variable-voltage power source 180 is electrically connected to the periphery of the organic EL display unit 110, and potential supplied by the variable-voltage source 180 to the periphery of the organic EL display unit 110 is applied to the respective pixels 111 via the first power source wire 112 and the second power source wire 113. In FIG. 2, the first power source wire 112 and the second power source wire 113 are schematically illustrated in mesh-form in order to show the resistance components of the first power source wire 112 and the second power source wire 113.

A horizontal first power source wire resistance R1*h* and a vertical first power source wire resistance R1*v* are present in the first power source wire 112. A horizontal second power source wire resistance R2*h* and a vertical second power source wire resistance R2*v* are present in the second power source wire 113. It is to be noted that, although not illustrated, each of the pixels 111 is connected to a scanning line for controlling the timing at which the pixel 111 produces luminescence and stops producing luminescence and a data line for supplying a signal voltage corresponding to the luminescence luminance of the pixel 111, and is connected to the write scan driving circuit 130 and the data line driving circuit 120 via the scanning line and the data line.

Figure 3:
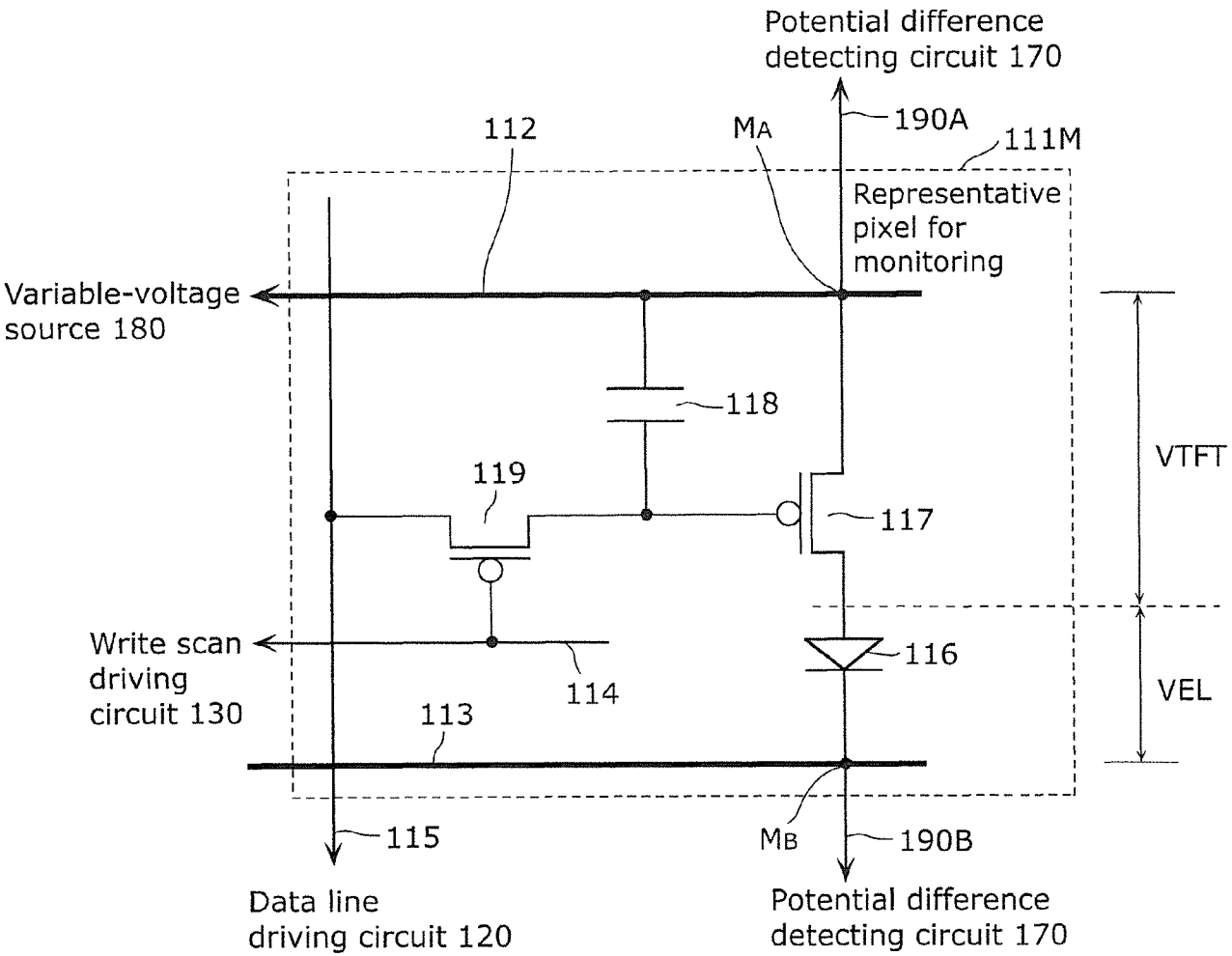
FIG. 3 is a circuit diagram showing an example of a specific configuration of a pixel.

FIG. 3 is a circuit diagram showing an example of a specific configuration of a pixel 111. The pixel 111 shown in the figure includes a driving element and a luminescence element. The driving element includes a source electrode and a drain electrode. The luminescence element includes a first electrode and a second electrode. The first electrode is connected to one of the source electrode and the drain electrode of the driving element. The high-side potential is applied to one of (i) the other of the source electrode and the drain electrode and (ii) the second electrode, and the low-side potential is applied to the other of (i) the other of the source electrode and the drain electrode and (ii) the second electrode. Specifically, each of the pixels 111 includes the first power source wire 112, the second power source wire 113, a scanning line 114, a data line 115, an organic EL element 116, a driving transistor 117, a holding capacitor 118, and a switch transistor 119.

The organic EL element 116 is a luminescence element which has an anode electrode, which is a first electrode, connected to the drain electrode of the driving transistor 117 and a cathode electrode, which is a second electrode, connected to the second power source wire 113, and produces luminescence with a luminance that is in accordance with the pixel current $i_{pix}$ flowing between the anode electrode and the cathode electrode. The cathode electrode of the organic EL element 116 forms part of a common electrode provided in common to the pixels 111. The common electrode is electrically connected to the variable-voltage source 180 so that potential is applied to the common electrode from the periphery thereof. Specifically, the common electrode functions as the second power source wire 113 in the organic EL display unit 110.

The data line 115 is connected to the data line driving circuit 120 and one of the source electrode and the drain electrode of the switch transistor 119, and signal voltage corresponding to video data is applied to the data line 115 by the data line driving circuit 120.

The scanning line 114 is connected to the write scan driving circuit 130 and the gate electrode of the switch transistor 119, and switches between conduction and non-conduction of the switch transistor 119 according to the voltage applied by the write scan driving circuit 130.

The switching transistor 119 has one of a source electrode and a drain electrode connected to the data line 115, the other of the source electrode and the drain electrode connected to the gate electrode of the driving transistor 117 and one end of the holding capacitor 118, and is, for example, a P-type thin-film transistor (TFT).

The driving transistor 117 is a driving element having a source electrode connected to the first power source wire 112, a drain electrode connected to the anode electrode of the organic EL element 116, and a gate electrode connected to the one end of the holding capacitor 118 and the other of the source electrode and the drain electrode of the switch transistor 119, and is, for example, a P-type TFT. With this, the driving transistor 117 supplies the organic EL element 116 with current that is in accordance with the voltage held in the holding capacitor 118. Furthermore, in the representative pixel 111M for monitoring, the source electrode of the driving transistor 117 is the anode electrode of the representative pixel 111M and is connected to the monitor wire 190A. On the other hand, in the representative pixel 111M for monitoring, the cathode electrode of the organic EL element 116 is the cathode electrode of the representative pixel 111M and is connected to the monitor wire 190B.

The holding capacitor 118 has one end connected to the other of the source electrode and the drain electrode of the switch transistor 119, and the other end connected to the first power source wire 112, and holds the potential difference between the potential of the first power source wire 112 and the potential of the gate electrode of the driving transistor 117 when the switch transistor 119 becomes non-conductive. Specifically, the holding capacitor 126 holds a voltage corresponding to the signal voltage.

The functions of the respective constituent elements shown in FIG. 1 shall be described below with reference to FIG. 2 and FIG. 3.

The data line driving circuit 120 outputs a signal voltage corresponding to the video data, to the pixels 111 via the data lines 115.

The write scan driving circuit 130 sequentially scans the pixels 111 by outputting a scanning signal to the scanning lines 114. Specifically, the switch transistors 119 are switched between conduction and non-conduction on a row-basis. With this, the signal voltages outputted to the data lines 115 are applied to the pixels 111 in the row selected by the write scan driving circuit 130. Therefore, the pixels 111 produce luminescence with a luminance that is in accordance with the video data.

The control circuit 140 instructs the drive timing to each of the data line driving circuit 120 and the write scan driving circuit 130.

The peak signal detecting circuit 150 detects the peak value of the video data inputted to the display device 100, and outputs a peak signal representing the detected peak value to the signal processing circuit 160. Specifically, the peak signal detecting circuit 150 detects, as the peak value, data of the highest gradation level out of the video data. High gradation level data corresponds to an image that is to be displayed brightly by the organic EL display unit 110.

The signal processing circuit 160 determines the voltage to be applied to the pixels 111 and is required by the organic EL element 116 and the driving transistor 117 in order to cause the pixels 111 to produce luminescence according to the peak signal outputted from the peak signal detecting circuit 150. Specifically, the signal processing circuit 160 supplies a high-side potential corresponding to a sum voltage (VEL+VTFT) of a voltage VEL required by the organic EL element 116 and a voltage VTFT required by the driving transistor 117, as a first reference potential Vref1, to the variable-voltage source 180. The first reference potential Vref1 is a preset potential in the positive electrode of the variable-voltage source 180.

Furthermore, the signal processing circuit 160 outputs, to the data line driving circuit 120, a signal voltage corresponding to the video data inputted via the peak signal detecting circuit 150.

The arithmetic circuit 170 calculates and outputs a converted potential which is a value obtained by adding up the negative electrode supply potential of the variable-voltage source 180 and the potential at the detecting point $M_A$ of the representative pixel 111M, and subtracting the potential at the detecting point $M_B$ of the representative pixel 111. It is to be noted that the arithmetic circuit 170 may be disposed inside the signal processing circuit 160.

The variable-voltage source 180 is a power supplying unit that compares the converted potential outputted from the arithmetic circuit 170 and the preset potential in the positive electrode of the variable-voltage source 180, and regulates the positive electrode supply potential of the variable-voltage source 180 in accordance with the resulting difference.

The monitor wire 190A has one end connected to the detecting point $M_A$ and the other end connected to the arithmetic circuit 170, and transmits the high-side potential, that is, the anode potential applied to the representative pixel 111M. Furthermore, the monitor wire 190B has one end connected to the detecting point $M_B$ and the other end connected to the arithmetic circuit 170, and transmits the low-side potential, that is, the cathode potential applied to the representative pixel 111M. Accordingly, the arithmetic circuit 170 can measure at least one of (i) the anode potential applied to at least one representative pixel, via a high-potential monitor wire and (ii) the cathode potential applied to at least one representative pixel, via a low-potential monitor wire.

The configuration and functions of the arithmetic circuit 170 and the variable-voltage source 180 shall be described below with reference to FIG. 4 to FIG. 7.

Figure 4:
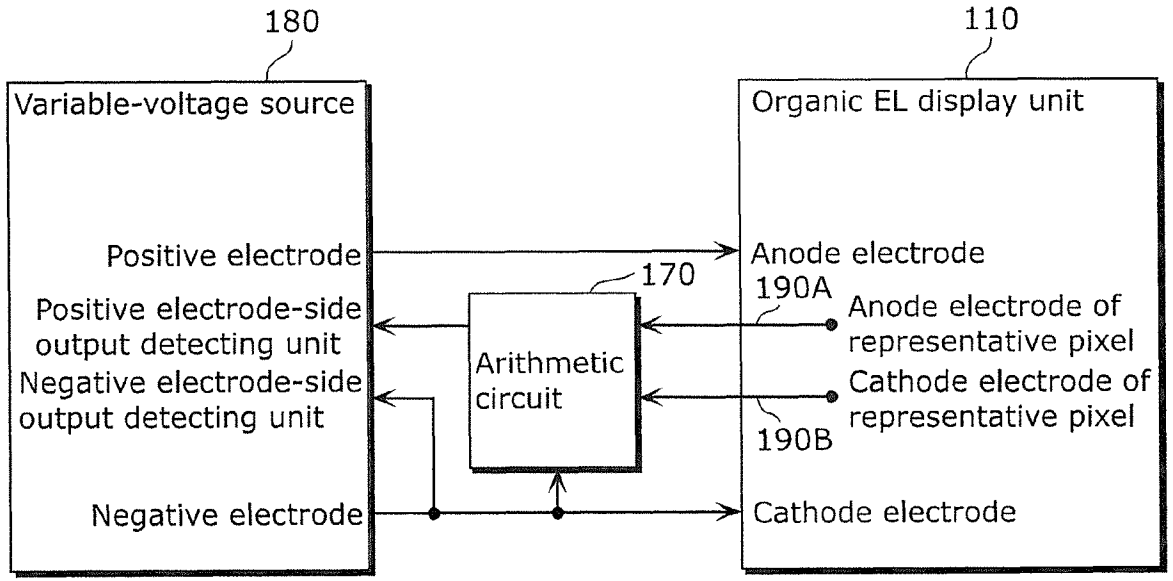
FIG. 4 is a block diagram of an arithmetic circuit and surrounding constituent elements according to Embodiment 1 of the present disclosure.

FIG. 4 is a block diagram of an arithmetic circuit and surrounding constituent elements according to Embodiment 1 of the present disclosure. In the figure, the positive electrode of the variable-voltage source 180 is connected to the anode electrode of the organic EL display unit 110, and the negative electrode of the variable-voltage source 180 is connected to the cathode electrode of the organic EL display unit 110 and to a negative electrode-side output detecting unit. Furthermore, the anode potential and the cathode potential of the representative pixel 111M included in the organic EL display unit 110 and the negative electrode potential of the variable-voltage source 180 are inputted to the arithmetic circuit 170, and arithmetic output is fed back to a positive electrode-side output detecting unit of the variable-voltage source 180.

The arithmetic circuit 170 functions as a voltage measuring unit that measures the anode potential and cathode potential applied to the representative pixel 111M. Specifically, the arithmetic circuit 170 measures, via the monitor wire 190A, the anode potential applied to the representative pixel 111M, and measures, via the monitor wire 190B, the cathode potential applied to the representative pixel 111M. Furthermore, the arithmetic circuit 170 measures the negative electrode supply potential of the variable-voltage source 180. With this, the arithmetic circuit 170 performs a predetermined arithmetic processing based on the potential at the detecting point $M_A$, the potential at the detecting point $M_B$, and the negative electrode supply potential of the variable-voltage source 180 that have been measured. The predetermined arithmetic processing shall be described below using FIG. 5.

Figure 5:
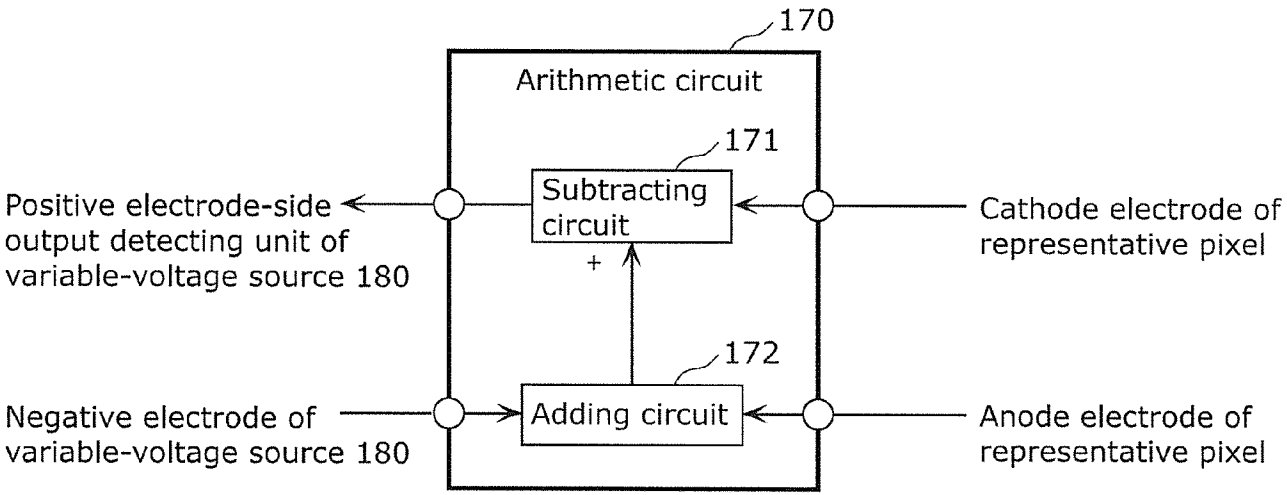
FIG. 5 is a function block diagram of the arithmetic circuit according to Embodiment 1 of the present disclosure.

FIG. 5 is a function block diagram of the arithmetic circuit according to Embodiment 1 of the present disclosure. The arithmetic circuit 170 shown in the figure includes a subtracting circuit 171 and an adding circuit 172.

The arithmetic circuit 170 first adds up the negative electrode supply potential of the variable-voltage source 180 and the anode potential of the detecting point $M_A$, using the adding circuit 172. Next, the arithmetic circuit 170 calculates the converted potential obtained by subtracting, using the subtracting circuit 171, the cathode potential of the detecting point $M_B$ from the sum potential obtained using the adding circuit 172. The aforementioned converted potential is inputted to the positive electrode-side output detecting unit via an output detecting terminal of the variable-voltage source 180.

Figure 6:
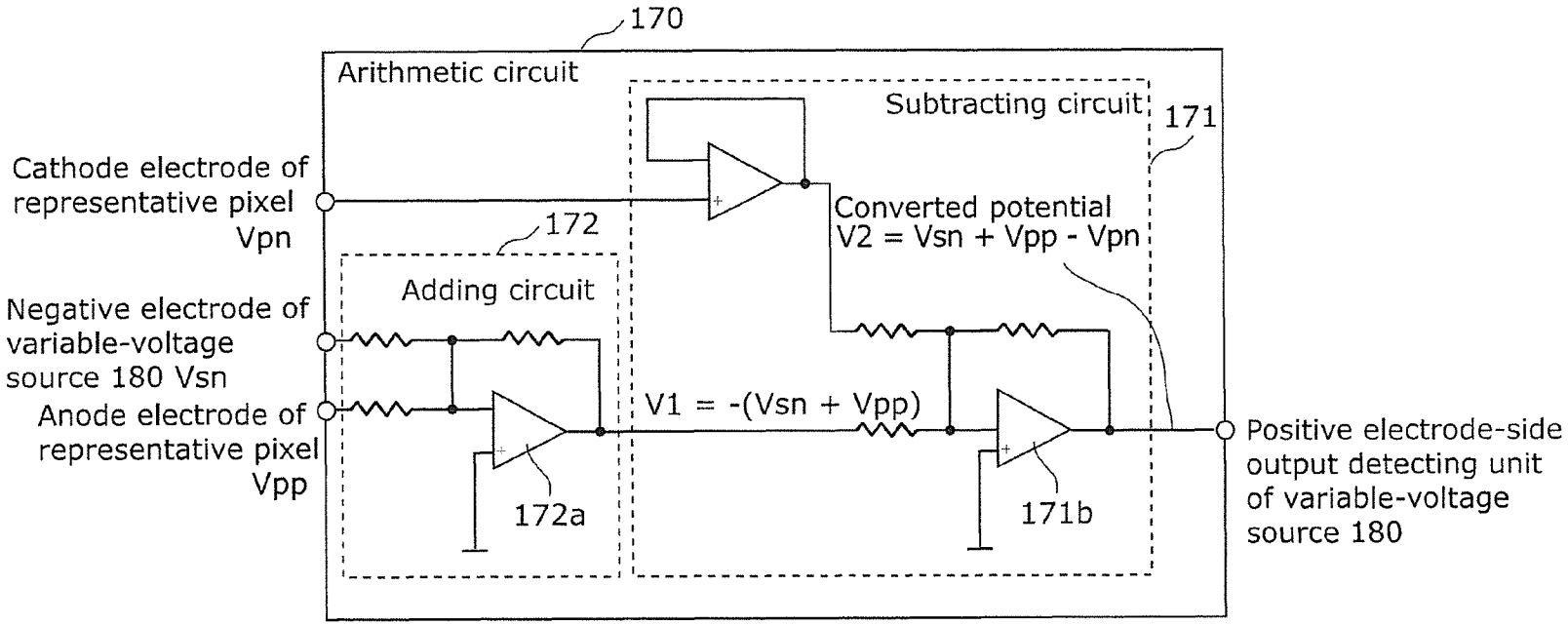
FIG. 6 is an example of a circuit diagram for the arithmetic circuit according to Embodiment 1 of the present disclosure.

FIG. 6 is an example of a circuit diagram for the arithmetic circuit according to Embodiment 1 of the present disclosure. As shown in the figure, the adding circuit 172 and the subtracting circuit 171 are both configured of an operational amplifier and a resistor element. A negative electrode supply potential Vsn of the variable-voltage source 180 and an anode potential Vpp of the detecting point $M_A$ are inputted to the adding circuit 172. A potential V1 obtained by inverting the sum potential of these two potentials using an operational amplifier 172*a* is outputted from the adding circuit 172. V1 is represented using Equation 1 below.

$$V1=-(Vsn+Vpp) \quad \text{(Equation 1)}$$

Next, the potential V1 and a cathode potential Vpn of the detecting point $M_A$ is inputted to the subtracting circuit 171. A potential V2 obtained by inverting the sum potential of Vpn and V1 inputted to the adding circuit 171, using an operational amplifier 171*b*, is outputted from the adding circuit 171 as the converted potential, and is inputted to the positive-side output detecting unit of the variable-voltage source 180. The converted potential V2 is represented using Equation 2 below.

$$V2=-(Vpn+V1)=Vsn+Vpp-Vpn \quad \text{(Equation 2)}$$

From Equation 2, it can be seen that the arithmetic circuit 170 adds up the potential Vsn of the variable-voltage source 180 and the anode potential Vpp of the detecting point $M_A$, and subtracts the cathode potential Vpn of the detecting point $M_B$ It is to be noted that although the arithmetic circuit 170 shown in FIG. 5 has as input potentials the negative electrode supply potential of the variable-voltage source 180, the anode potential of the detecting point $M_A$, and the cathode potential of the detecting point $M_B$, and calculates the converted potential through the addition and subtraction of these input potentials, the order of such addition and subtraction does not matter. Although addition is executed first after which subtraction is executed in FIG. 5, it is also acceptable to subtract the anode potential of the detecting point $M_B$ from the negative electrode supply potential of the variable-voltage source 180 first and then add the cathode potential of the detecting point $M_A$, or subtract the cathode potential of the detecting point $M_B$ from the anode potential of the detecting point $M_A$ and then add the negative electrode supply potential of the variable-voltage source 180.

However, when the arithmetic circuit is an analog arithmetic circuit, the adding circuit and the subtracting circuit need to be disposed appropriately so that the sum potential or difference potential generated midway through the computation does not exceed the operating power source voltage for operating the arithmetic circuit. This is because, when the sum potential or difference potential generated midway through the arithmetic computation becomes big, the operating power source voltage of the arithmetic circuit needs to be set bigger accordingly, which eventually leads to an increase in power consumption.

Next, the configuration and function of the variable-voltage source 180 to which the aforementioned converted potential V2 has been inputted shall be described.

Figure 7:
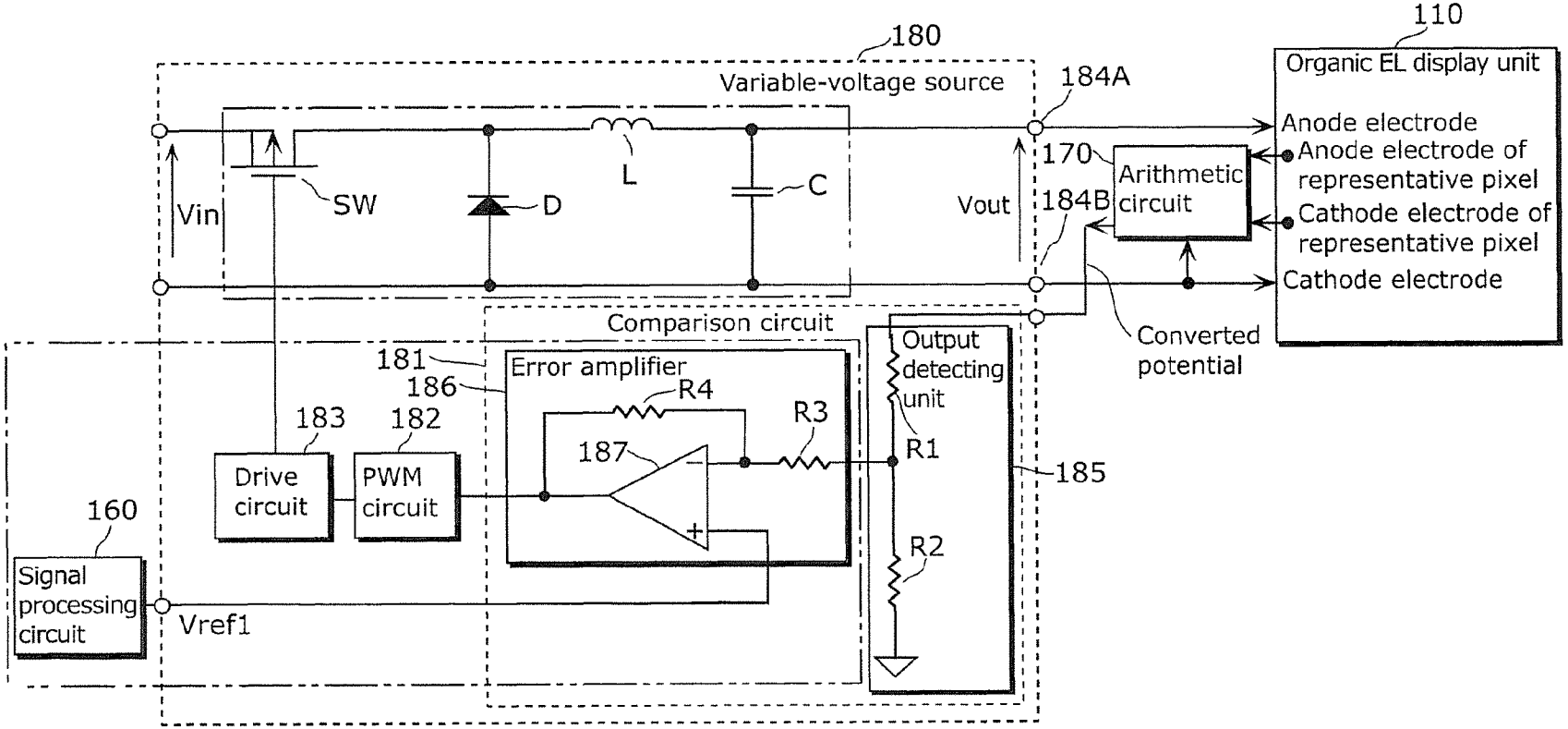
FIG. 7 is a block diagram showing an example of a specific configuration of a variable-voltage source according to Embodiment 1 of the present disclosure.

FIG. 7 is a block diagram showing an example of a specific configuration of the variable-voltage source according to Embodiment 1 of the present disclosure. It is to be noted that the organic EL display unit 110, the signal processing circuit 160, and the arithmetic circuit 170 which are connected to the variable-voltage source 180 are also shown in the figure.

The variable-voltage source 180 shown in the figure includes a comparison circuit 181, a pulse width modulation (PWM) circuit 182, a drive circuit 183, a switch SW, a diode D, an inductor L, a capacitor C, a positive electrode-side output terminal 184A, and a negative electrode-side output terminal 184B, and converts an input voltage Vin into an output voltage Vout which is in accordance with the first reference potential Vref1. Subsequently, the variable-voltage source 180 supplies a high-side potential that is in accordance with the Vout from the positive electrode-side terminal 184A while keeping a low-side potential from the negative electrode-side terminal 184B fixed. It is to be noted that, although not illustrated, an AC-DC converter is provided in a stage ahead of an input terminal to which the input voltage Vin is inputted, and it is assumed that conversion, for example, from 100V AC to 20V DC is already carried out.

The comparison circuit 181 includes an output detecting unit 185 and an error amplifier 186, and outputs, to the PWM circuit 182, a voltage that is in accordance with the difference between the converted potential V2 outputted from the arithmetic circuit 170 and the first reference potential Vref1.

The output detecting unit 185, which includes two resistors R1 and R2 provided between the output of the arithmetic circuit 170 and a grounding potential, voltage-divides the converted potential V2 in accordance with the resistance ratio between the resistors R1 and R2, and outputs the voltage-divided converted potential to the error amplifier 186.

The error amplifier 186 compares the converted potential that has been voltage-divided by the output detection unit 185 and the first reference potential Vref1 outputted from the signal processing circuit 160, and outputs, to the PWM circuit 182, a voltage that is in accordance with the comparison result. Specifically, the error amplifier 186 includes an operational amplifier 187 and resistors R3 and R4. The operational amplifier 187 has an inverting input terminal connected to the output detecting unit 185 via the resistor R3, a non-inverting input terminal connected to the signal processing circuit 160, and an output terminal connected to the PWM circuit 182. Furthermore, the output terminal of the operational amplifier 187 is connected to the inverting input terminal via the resistor R4. With this, the error amplifier 186 outputs, to the PWM circuit 182, a voltage that is in accordance with the potential difference between the potential inputted from the output detecting unit 185 and the first reference potential Vref1 inputted from the signal processing circuit 160. Stated differently, the error amplifier 186 outputs, to the PWM circuit 182, a voltage that is in accordance with the potential difference between the converted potential V2 and the first reference potential Vref1.

The PWM circuit 182 outputs, to the drive circuit 183, pulse waveforms having different duties depending on the voltage outputted by the comparison circuit 181. Specifically, the PWM circuit 182 outputs a pulse waveform having a long ON duty when the voltage outputted by the comparison circuit 181 is large, and outputs a pulse waveform having a short ON duty when the outputted voltage is small. Stated differently, the PWM circuit 182 outputs a pulse waveform having a long ON duty when the converted potential is lower than the first reference potential Vref1, and outputs a pulse waveform having a short ON duty when the converted potential is higher than the first reference potential Vref1. It is to be noted that the ON period of a pulse waveform is a period in which the pulse waveform is active.

The drive circuit 183 turns ON the switch SW during the period in which the pulse waveform outputted by the PWM circuit 182 is active, and turns OFF the switch SW during the period in which the pulse waveform outputted by the PWM circuit 182 is inactive.

The switch SW is turned ON and OFF by the drive circuit 183. The input voltage Vin is outputted, as the output voltage Vout, to the positive electrode-side output terminal 184A and the negative electrode-side output terminal 184B via the inductor L and the capacitor C only while the switch SW is ON. Accordingly, from 0V, the output voltage Vout gradually approaches 20V (Vin). During this time, the high-side potential is supplied from the positive electrode-side output terminal 184A to the organic EL display unit 110 in response to the output voltage Vout. Accordingly, the converted potential outputted from the arithmetic circuit 170 also changes. As the converted potential approaches the first reference potential Vref1, the voltage inputted to the PWM circuit 182 decreases, and the ON duty of the pulse signal outputted by the PWM circuit 182 becomes shorter. Then, the time for which the switch SW is ON becomes shorter, the output voltage Vout gently converges and settles to a fixed voltage.

In this manner, the variable-voltage source 180 generates an output voltage Vout by which that the converted potential V2 outputted from the arithmetic circuit 170 becomes the first reference potential Vref1, and regulates and supplies only the potential from the positive electrode-side output terminal to the organic EL display unit 110.

Specifically, the variable-voltage source 180 compares the converted potential V2 outputted from the arithmetic circuit 170 and the first reference potential Vref1 which is the preset potential, raises the positive electrode supply potential with respect to the negative electrode supply potential as the converted potential V2 is lower than the first reference potential Vref1, and supplies the positive electrode supply potential to the organic EL display unit 110.

Figures 8, 9:
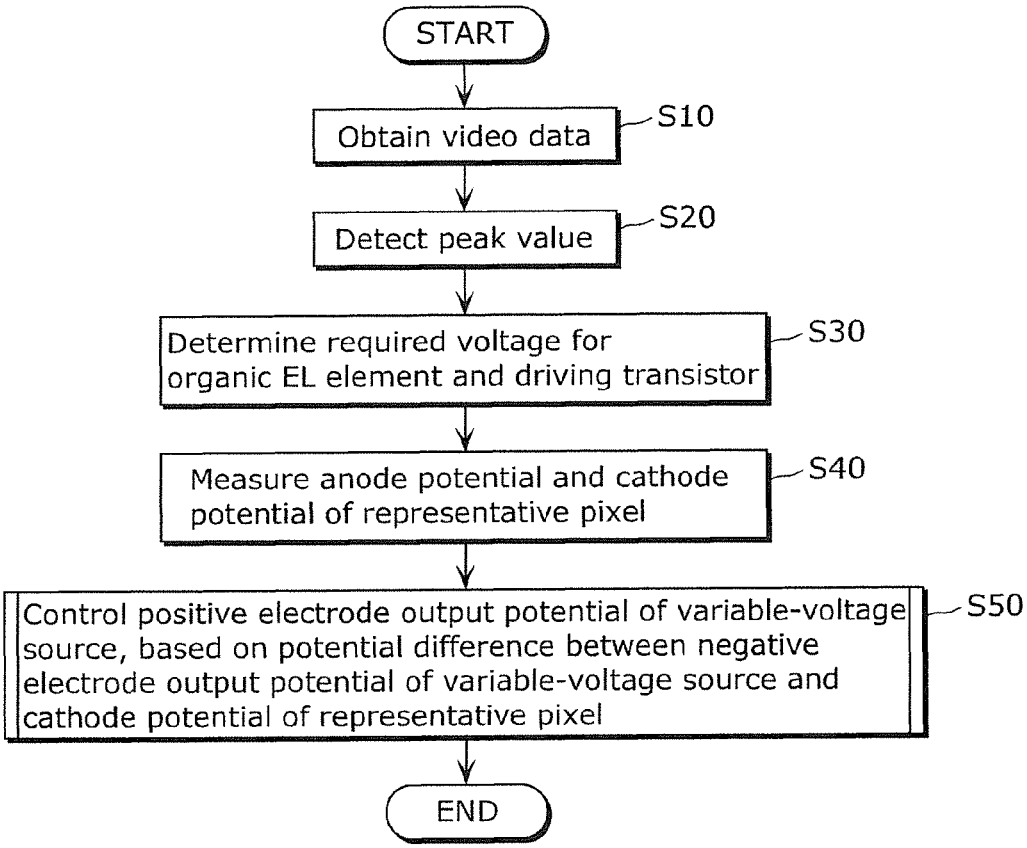
FIG. 8 is a flowchart showing the operation of the display device according to Embodiment 1 of the present disclosure.
FIG. 9 is a chart showing an example of a required voltage conversion table provided in a signal processing circuit according to Embodiment 1.
Figure 10:
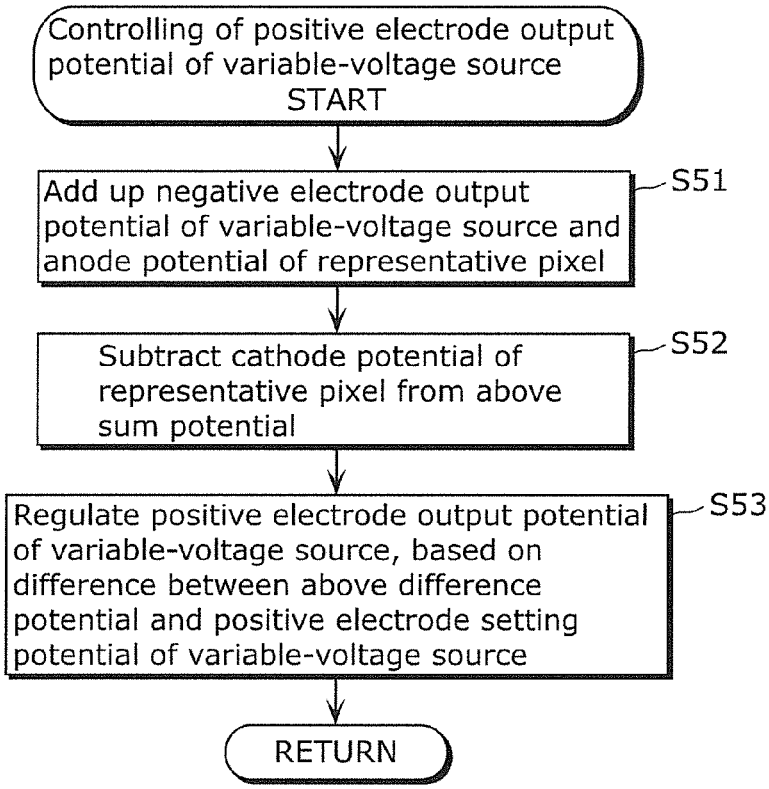
FIG. 10 is a flowchart showing the operation of the arithmetic circuit and the variable-voltage source according to Embodiment 1 of the present disclosure.

Next, the aforementioned arithmetic processing operation by the arithmetic circuit 170 and the supply potential regulating operation by the variable-voltage source 180 shall be described using a specific case example and FIG. 8 to FIG. 10.

FIG. 8 is a flowchart showing the operation of the display device according to Embodiment 1 of the present disclosure.

First, the peak signal detecting circuit 150 obtains the video data for one frame period inputted to the display device 100 (step S10). For example, the peak signal detecting circuit 150 includes a buffer and stores the video data for one frame period in such buffer.

Next, the peak signal detecting circuit 150 detects the peak value of the obtained video data (step S20), and outputs a peak signal representing the detected peak value to the signal processing circuit 160. Specifically, the peak signal detecting circuit 150 detects the peak value of the video data for each color. For example, for each of red (R), green (G), and blue (B), the video data is expressed using the 256 gradation levels from 0 to 255 (luminance being higher with a larger value). Here, when part of the video data of the organic EL display unit 110 has R:G:B=177:124:135, another part of the video data of the organic EL display unit 110 has R:G:B=24:177:50, and yet another part of the video data of the organic EL display unit 110 has R:G:B=10:70:176, the peak signal detecting circuit 150 detects 177 as the peak value of R, 177 for the peak value of G, and 176 as the peak value of B, and outputs, to the signal processing circuit 160, a peak signal representing the detected peak value of each color.

Next, the signal processing circuit 160 determines the voltage VTFT required by the driving transistor 117 and the voltage VEL required by the organic EL element 116 when causing the organic EL element 116 to produce luminescence according to the peak signal outputted by the peak signal detecting circuit 150 (step S30). Specifically, the signal processing circuit 160 determines the VTFT+VEL corresponding to the gradation levels for each color, using a required voltage conversion table indicating the required voltage VTFT+VEL corresponding to the gradation levels for each color.

FIG. 9 is a chart showing an example of a required voltage conversion table provided in the signal processing circuit according to Embodiment 1 of the present disclosure.

As shown in the figure, required voltages VTFT+VEL respectively corresponding to the gradation levels of each color are stored in the required voltage conversion table. For example, the required voltage corresponding to the peak value 177 of R is 8.5V, the required voltage corresponding to the peak value 177 of G is 9.9V, and the required voltage corresponding to the peak value 176 of B is 6.7V. Among the required voltages corresponding to the peak values of the respective colors, the largest voltage is 9.9 V corresponding to the peak value of G. Therefore, the signal processing circuit 160 determines VTFT+VEL to be 9.9V. With this, the case where, for example, the signal processing circuit 160 sets the positive electrode potential of the variable-voltage source 180 to a preset potential 6.9 V, and sets the negative electrode potential of the variable-voltage source 180 to a predetermined setting potential −3 V is assumed. The signal processing circuit 160 supplies the preset potential 6.9 V as the positive electrode potential of the variable-voltage source 180, to the variable-voltage source 180, as the first reference potential Vref1.

Meanwhile, the arithmetic circuit 170 measures the anode potential of the detecting point $M_A$ and the cathode potential of the detecting point $M_B$ via the monitor wires 190A and 190B, respectively (step S40). In the above-described step S30, the positive electrode potential (6.9 V) and the negative electrode potential (−3 V) of the variable-voltage source 180 that are set by the signal processing circuit 160 are supplied to the organic EL display unit 110 as initial preset potentials. With this, it is assumed that the potentials at the detecting points $M_A$ and $M_B$ of the representative pixel 111M are affected by the voltage drop occurring in power source wires and are measured as 5.5 and −1 V, respectively. Specifically, with respect to the voltage magnitude of 9.9 V that should be applied to the respective pixels 111, the magnitude of the voltage applied to the representative pixel 111 is 6.5 V (5.5 V−(−1 V).

Next, the display device 100 controls the positive electrode supply potential of the variable-voltage source 180, based on the potential difference between the negative electrode supply potential of the variable-voltage source 180 and the cathode potential of the detecting point $M_B$ and the potential difference between the positive electrode supply potential of the variable-voltage source 180 and the anode potential of the detecting point $M_A$ (step S50). The operation in step S50 shall be described in detail below.

FIG. 10 is a flowchart showing the operation of the arithmetic circuit and the variable-voltage source.

In the operation for controlling the positive electrode supply potential of the variable-voltage source 180 in step S50, first, the arithmetic circuit 170 adds up the negative electrode potential of the variable-voltage source 180 and the anode potential of the detecting point $M_A$ using the adding circuit 172, as described using FIG. 5. Here, the negative electrode potential (−3 V) of the variable-voltage source 180 and the 5.5 V anode potential of the detecting point $M_A$ are added up, and a sum potential of 2.5 V is obtained.

Next, the arithmetic circuit 170 calculates the converted potential obtained by subtracting the cathode potential of the detecting point $M_B$ from the sum potential (step S52), using the subtracting circuit 171. Here, the cathode potential (−1 V) of the detecting point $M_B$ is subtracted from the 2.5 V sum potential of the variable-voltage source 180, and a converted potential of 3.5 V is obtained.

Next, the variable-voltage source 180 regulates the positive electrode supply potential of the variable-voltage source 180 according to the potential difference between the converted potential (3.5 V) and the first reference potential (6.9 V) (step S53). Specifically, both potentials are compared by the comparison circuit 181 and the PWM circuit 182 and the drive circuit 183 are driven according to the resulting difference signal, and thereby the positive electrode supply potential of the variable-voltage source 180 with respect to the negative electrode supply potential to bring the conversion potential closer to the first reference potential. As the conversion potential approaches the first reference potential, the output voltage Vout between the positive electrode-side output terminal 184A and the negative electrode-side output terminal 184B converges and settles to a fixed voltage.

Through the above-described operation of the arithmetic circuit 170 and the variable-voltage source 180, a converted potential (3.5 V in the above case example) obtained by subtracting, from the anode ($M_A$) potential (5.5 V in the above case example) of the representative pixel 111M, the rise in voltage (2 V in the above case example) caused by the cathode power source wire is generated and outputted.

Since the converted potential becomes a potential obtained by subtracting, from the first reference potential (6.9 V in the above case example) that is predetermined as the positive electrode potential of the variable-voltage source 180, the absolute value (1.4 V in the above case example) of the amount of voltage drop occurring in the anode power source wire and the absolute value (2 V in the above case example) of the amount of voltage drop occurring in the cathode power source wire of the organic EL display unit 110, and is fed back to the positive electrode-side output detecting unit, control for compensating for the voltage drop and voltage rise occurring in both the anode electrode and cathode electrode can be implemented in the variable-voltage source 180 despite using only the positive electrode-side output detecting unit. Specifically, the lower the converted potential is compared to the first reference potential, the more the positive electrode supply potential of the variable-voltage source 180 is regulated to be higher. In this case, the variable-voltage source 180 only needs a single output detecting terminal, and thus cost can be reduced.

Figure 11:
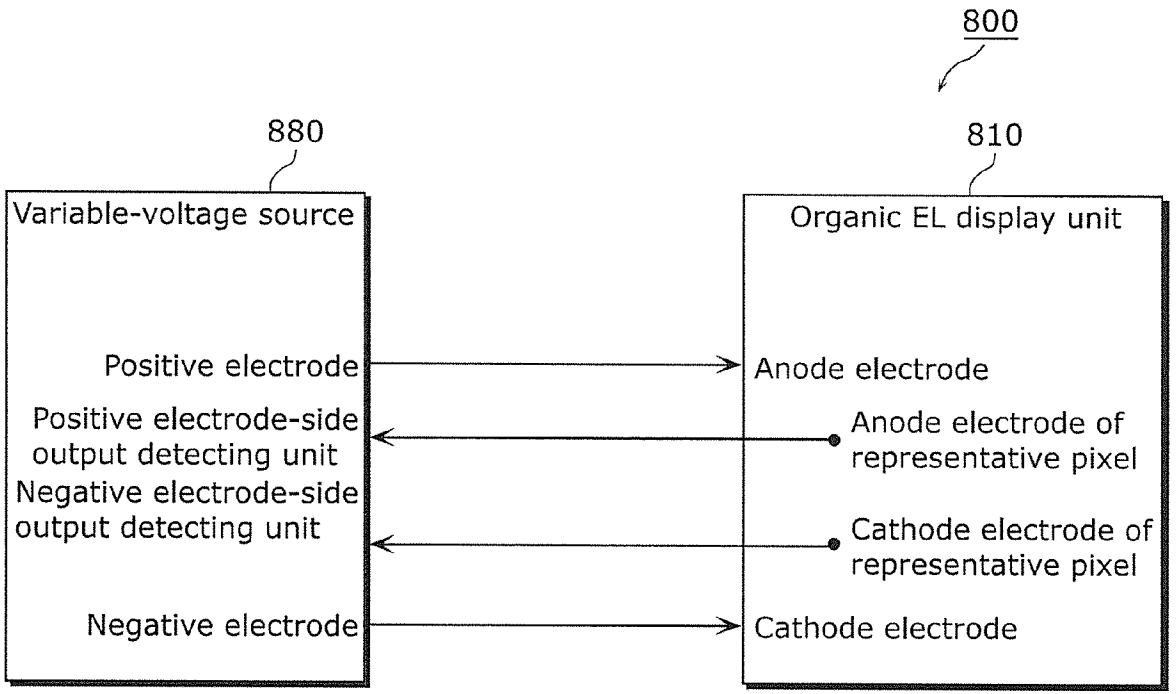
FIG. 11 is a block diagram showing part of the configuration of a display device that does not include an arithmetic circuit.

On the other hand, the configuration of a display device as shown in FIG. 11 is given as a measure for solving the problems of luminance variation and power consumption increase caused by voltage drops occurring in the power source wire.

FIG. 11 is a block diagram showing part of the configuration of a display device that does not include an arithmetic circuit. In the figure, the positive electrode of a variable-voltage source 880 is connected to the anode electrode of an organic EL display unit 810, and the negative electrode of the variable-voltage source 880 is connected to the cathode electrode of the organic EL display unit 810. Furthermore, the anode electrode of the representative pixel included in the organic EL display unit 810 is connected to the positive electrode-side output detecting unit of the variable-voltage source 880, and the cathode electrode of the representative pixel is connected to the negative electrode-side output detecting unit of the variable-voltage source 880.

According to this configuration, it is possible to feed back the anode potential of the representative pixel to the variable-voltage source 880 and regulate the positive electrode supply potential of the variable-voltage source 880, and to feed back the cathode potential of the representative pixel to the variable-voltage source 880 and regulate the negative electrode supply potential of the variable-voltage source 880. Therefore, by sending feedback to the variable-voltage source 880, depending on the displayed video, so as to compensate for the voltage drop occurring in both the anode power source wire and the cathode power source wire the maximum power consumption reducing effect can be obtained.

However, in the display device 800 shown in FIG. 11, it is necessary to provide an output terminal to both the positive electrode-side and the negative electrode-side of the variable-voltage source 880. Furthermore, when the variable-voltage source 880 is configured of a DC-to-DC converter, the potential difference between the negative electrode terminal and the negative electrode-side output detecting terminal is, for purposes of use, generally limited to be within a voltage that is limited according to the internal reference voltage. The voltage limit is often 1 V or less, and when the potential difference between the negative electrode supply potential of the variable-voltage source 880 and the cathode potential of the representative pixel exceeds the voltage limit in a large-sized display panel, there is the problem that normal feedback operation in accordance with the voltage drop amount cannot be implemented. Setting the aforementioned voltage limit sufficiently high in response to this problem brings about the problem that the cost of the variable-voltage source increases. In addition, since the configuration shown in FIG. 11 requires the two systems of the positive electrode feedback and negative electrode feedback, two output detecting terminals are required, and this point also leads to increased cost.

In contrast, since the display device 100 according to Embodiment 1 of the present disclosure regulates only the supply potential of the positive electrode of the variable-voltage source 180 in accordance with the amount of potential drop and the amount of potential rise in the anode electrode and cathode electrode that is detected by the representative pixel 111M, and, due to the placement of the arithmetic circuit 170, requires only a single output detecting terminal for the feedback of only the converted potential, the above-described problems are solved.

It is to be noted that although in the configuration of the display device according to the present disclosure shown in FIG. 4, the converted potential is outputted by inputting the anode potential and the cathode potential of the representative pixel 111M and the negative electrode potential of the variable-voltage source 180 to the arithmetic circuit 170, the present disclosure also includes the configuration in which the anode potential of the representative pixel 111M is not inputted to the arithmetic circuit 170.

Figure 12:
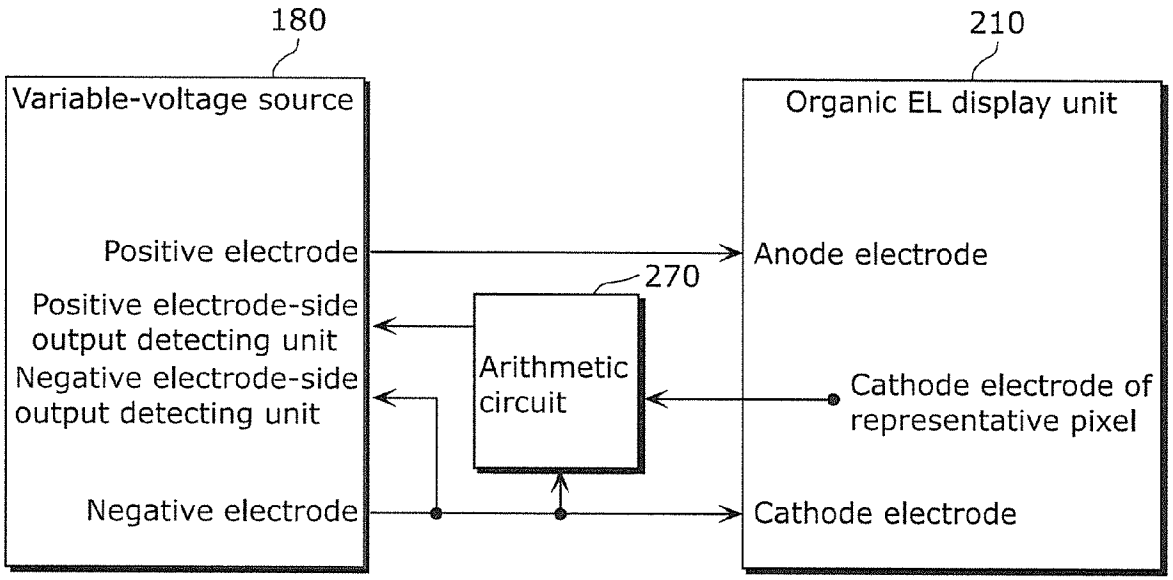
FIG. 12 is a block diagram of an arithmetic circuit and surrounding constituent elements representing a first modification of Embodiment 1 of the present disclosure.

FIG. 12 is a block diagram of an arithmetic circuit and surrounding constituent elements representing a first modification of Embodiment 1 of the present disclosure. The configuration shown in the figure is different from the configuration according to Embodiment 1 shown in FIG. 4 in that the cathode potential of a representative pixel included in an organic EL display unit 210 and the negative electrode potential of the variable-voltage source 180 are inputted to an arithmetic circuit 270 without inputting the anode potential of the representative pixel.

According to the aforementioned configuration, it becomes possible to appropriately regulate the positive electrode supply potential of the variable-voltage source 180 by feeding back, to the positive electrode of the variable-voltage source 180, the increase in the cathode potential of the representative pixel which has risen with respect to the negative electrode supply potential supplied from the variable-voltage source 180 to the organic EL display unit 210, under the influence of the power source wire. Specifically, even when there is a limit to the range of the supply potential of the negative electrode of the variable-voltage source 180, the appropriate voltage to be applied from the variable-voltage source 180 to the respective pixels, which takes into consideration the potential distribution inside the organic EL display unit 210, can be set by regulating the potential of the positive electrode relative to the negative electrode. Therefore, it is possible to realize a display device that appropriately deals with the variation in luminance between pixels and the change in pixel luminance over time while having excellent power consumption reducing effect.

The configuration shown in FIG. 12 is applied particularly in the case where the potential drop for the cathode power source wire is big compared to the potential rise for the anode power source wire.

Furthermore, although the potential difference between the negative electrode terminal and the negative electrode-side output detecting terminal needs to be below the predetermined voltage limit when the variable-voltage source 880 is configured of a DC-to-DC converter, the amount of voltage drop in the organic EL display unit may be corrected using the configuration shown in FIG. 11 when the potential difference is below the voltage limit, and the amount of voltage drop in the organic EL display unit may be corrected using the configuration of the present disclosure shown in FIG. 4 when the potential difference is greater than or equal to the voltage limit. This configuration is realized, for example, by appropriately placing a switch such that, from the connection state shown in FIG. 4, the cathode electrode of the representative pixel and the negative electrode-side output detecting unit are bypass-connected and the negative electrode of the variable-voltage source and the negative electrode-side output detecting unit are cut off, when the potential difference is below the voltage limit.

Furthermore, when the variable-voltage source is configured of an insulated DC-to-DC converter, there are cases where the positive electrode-side output of the variable-voltage source is fixed to a fixed potential by a separate fixed-voltage source. Even in the case of this configuration, the advantageous effects of the present disclosure are achieved as described below.

Figure 13:
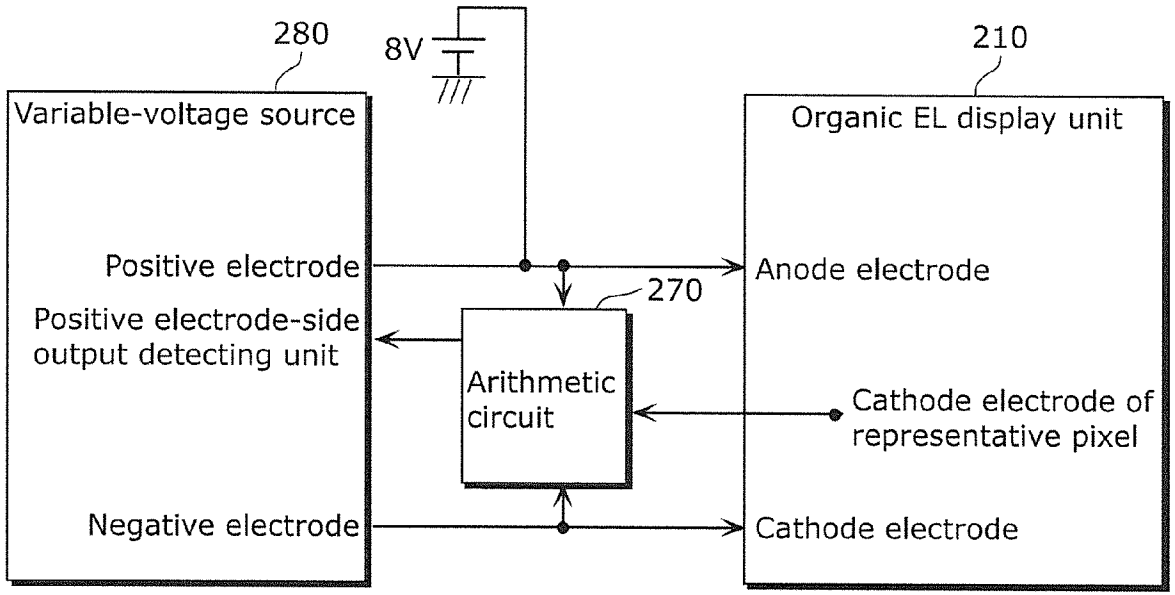
FIG. 13 is a block diagram of an arithmetic circuit and surrounding constituent elements representing a second modification of Embodiment 1 of the present disclosure.

FIG. 13 is a block diagram of an arithmetic circuit and surrounding constituent elements representing a second modification of Embodiment 1 of the present disclosure. The configuration shown in the figure is different from the configuration shown in FIG. 13 in that the positive electrode-side supply potential outputted by a variable-voltage source 280 is fixed to 8 V. Even in this configuration, the positive electrode supply potential is regulated relative to the negative electrode supply potential of the variable-voltage source 280 by feeding back, to the positive electrode of the variable-voltage source 280, the increase in the cathode potential of the representative pixel which has risen with respect to the negative electrode supply potential supplied from the variable-voltage source 280 to the organic EL display unit 210, under the influence of the power source wire. Here, since the positive electrode supply potential of the variable-voltage source 280 is kept fixed by the aforementioned insulated DC-to-DC converter, the negative electrode supply potential of the variable-voltage source 280 is regulated as a result. Therefore, the fixing of the positive electrode supply potential of the variable-voltage source 280 and the resulting regulation of the negative electrode potential is equivalent to supplying the organic EL display unit 210 with the positive electrode potential with respect to the negative electrode potential. The advantageous effects of the present disclosure can be produced even with this configuration.

Thus, according to above-described Embodiment 1, and in particular, by measuring both the anode potential applied to the representative pixel and the cathode potential applied to the representative pixel, and feeding back, to the positive electrode supply potential of the variable-voltage source, a voltage drop amount combining the potential difference occurring in both the anode potential-side power source wire and the cathode potential-side power source wire, it becomes possible to implement control for precisely compensating for the voltage drop occurring in both the anode electrode and the cathode electrode of a pixel even though the positive electrode potential is regulated in the variable-voltage source with respect to the negative electrode potential. Therefore, it is possible to set an appropriate variable-voltage source output voltage which takes into consideration the potential distribution inside the display unit, and thus it is possible to realize a display device that appropriately deals with the variation in luminance between pixels and the change in pixel luminance over time while having excellent power consumption reducing effect. In addition, since heat generation by the organic EL element 116 is suppressed through the reduction of power consumption, the deterioration of the organic EL element 116 can be prevented.

Embodiment 2

The display device according to the this embodiment is different compared to the display device 100 according to Embodiment 1 in terms of measuring the anode potential of plural representative pixels, measuring the cathode potential of plural representative pixels, and calculating the converted potential to be fed back to the variable-voltage source, using the measured anode potentials and cathode potentials.

With this, it is possible to more appropriately regulate the positive electrode supply potential with respect to the negative electrode supply potential of the variable-voltage source. Therefore, power consumption can be effectively reduced even when the organic EL display unit becomes large in size.

Figure 14:
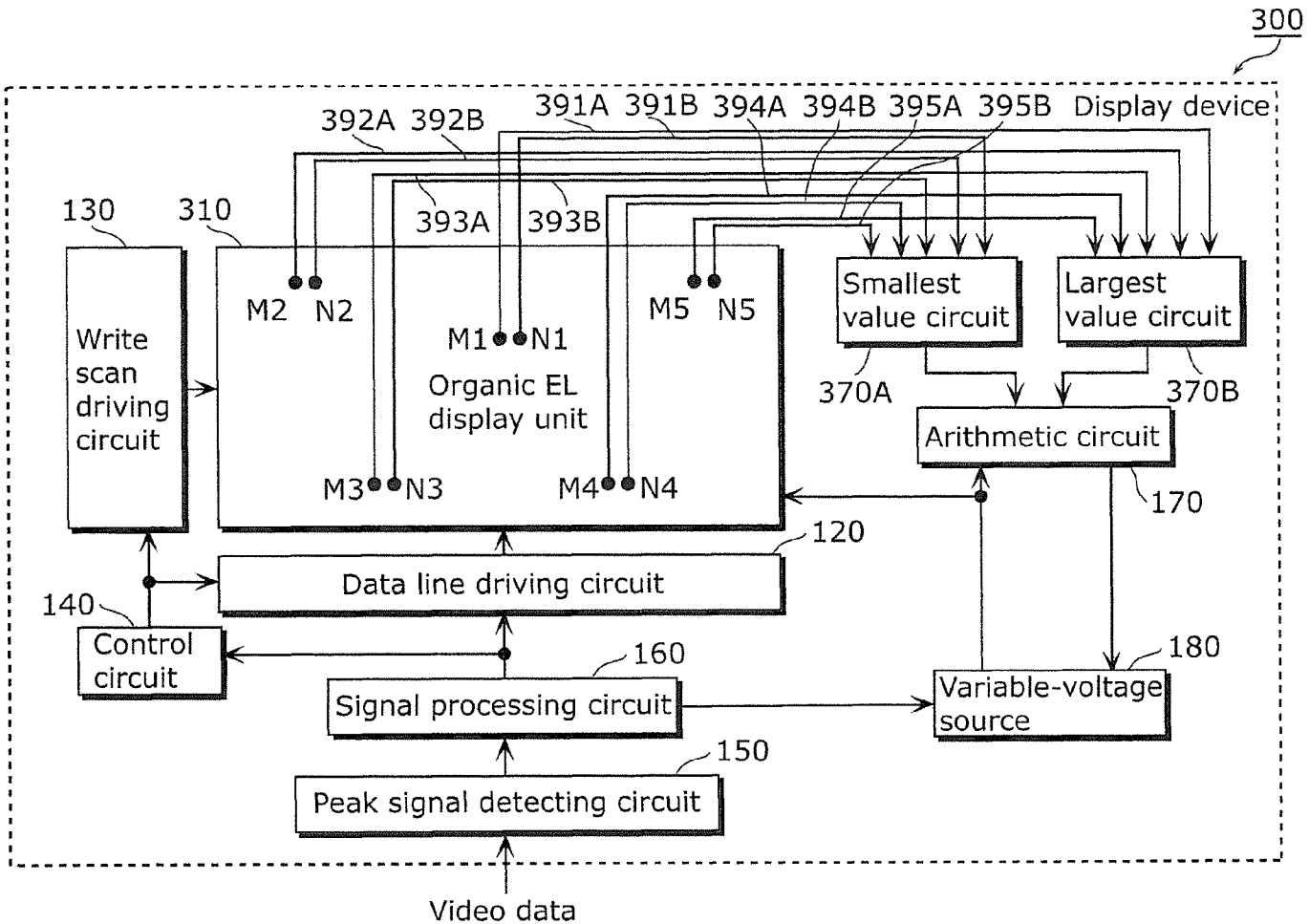
FIG. 14 is a block diagram showing an outline configuration of a display device according to Embodiment 2 of the present disclosure.

FIG. 14 is a block diagram showing an outline configuration of a display device according to Embodiment 2 of the present disclosure. A display device 300 shown in the figure includes an organic electroluminescence (EL) display unit 310, the data line driving circuit 120, the write scan driving circuit 130, the control circuit 140, the peak signal detecting circuit 150, the signal processing circuit 160, the arithmetic circuit 170, the variable-voltage source 180, a smallest value circuit 370A, a largest value circuit 370B, and monitor wires 391A to 395A, and monitor wires 391B to 395B.

A display device 300 shown in the figure is different from the display device 100 according to the Embodiment 1 in including the smallest value circuit 370A and the largest value circuit 370B, and in including the monitor wires 391A to 395A and the monitor wires 391B to 395B in place of the monitor wire 190.

The organic EL display unit 310 is provided with plural representative pixels, and each of anode detecting points M1 to M5 and each of cathode detecting points N1 to N5 are provided to a corresponding one of the representative pixels. It is preferable to provide the anode detecting points M1 to M5 and the cathode detecting points N1 to N5 evenly inside the organic EL display unit 310; for example, at the center of the organic EL display unit 310 and at the center of each region obtained by dividing the organic EL display unit 310 into four as shown in FIG. 14. It is to be noted that although the five of the anode detecting points M1 to M5 and the five cathode detecting points N1 to N5 are shown in the figure, there may be two, three, and so on, as long as there is a plurality of each of such detecting points. Furthermore, one of the anode detecting points and one of the cathode detecting may be the detecting points for the same representative pixel, and it is preferable that they are close to each other.

Each of the monitor wires 391A to 395A is connected to the corresponding one of the anode detecting points M1 to M5 and to the smallest value circuit 370A, and transmits the anode potential of the corresponding one of the anode detecting points M1 to M5 to the smallest value circuit 370A.

Each of the monitor wires 3916 to 395B is connected to the corresponding one of the cathode detecting points N1 to N5 and to the largest value circuit 370B, and transmits the cathode potential of the corresponding one of the anode detecting points N1 to N5 to the largest value circuit 370B.

Figure 15:
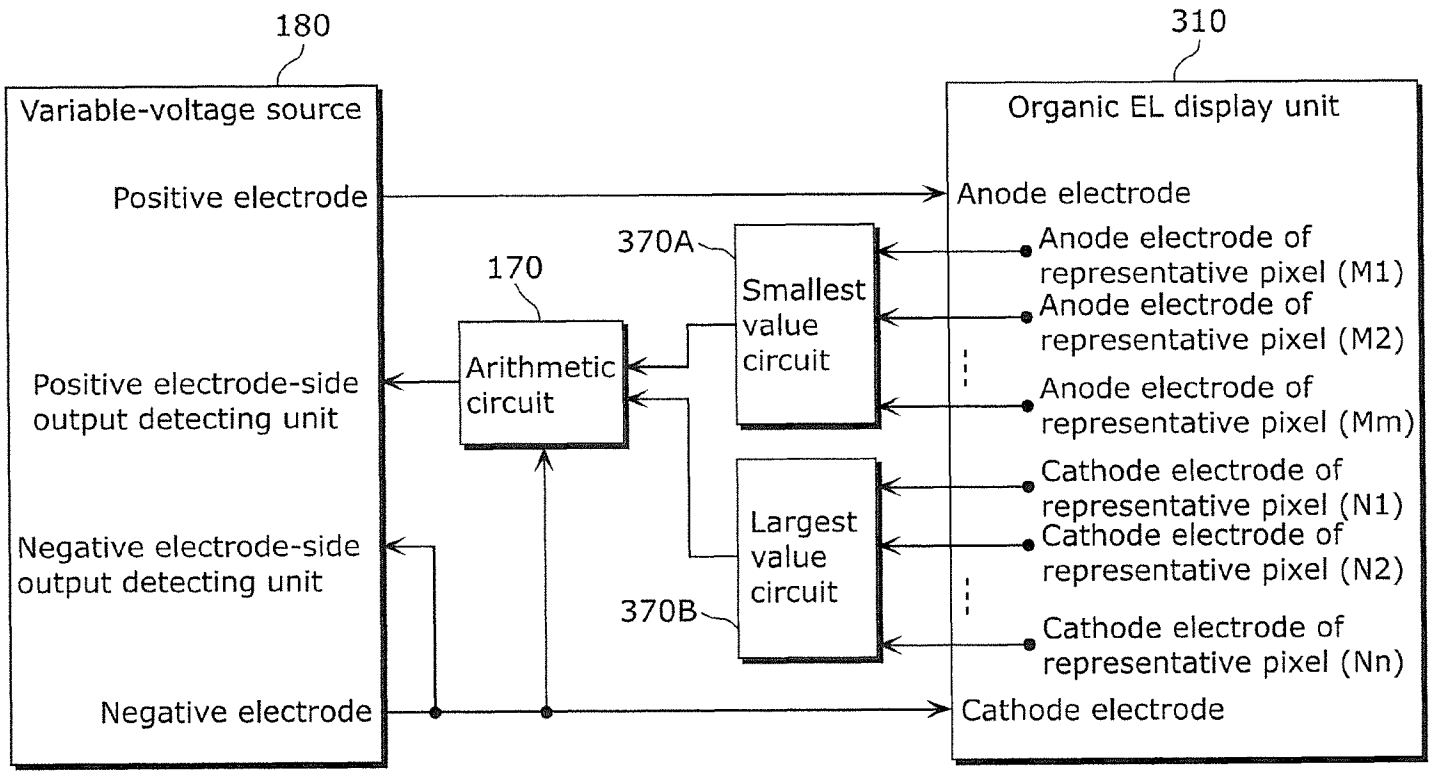
FIG. 15 is a block diagram of an arithmetic circuit and surrounding constituent elements according to Embodiment 2 of the present disclosure.

FIG. 15 is a block diagram of an arithmetic circuit and surrounding constituent elements according to Embodiment 2 of the present disclosure.

The smallest value circuit 370A is part of a voltage measuring unit that measures the respective anode potentials of the anode detecting points M1 to M5 via the monitor wires 391A to 395A, respectively. The smallest value circuit 370A detects the smallest potential among the anode potentials measured from the representative pixels, and outputs the detected smallest potential to the arithmetic circuit 170.

Figure 16:
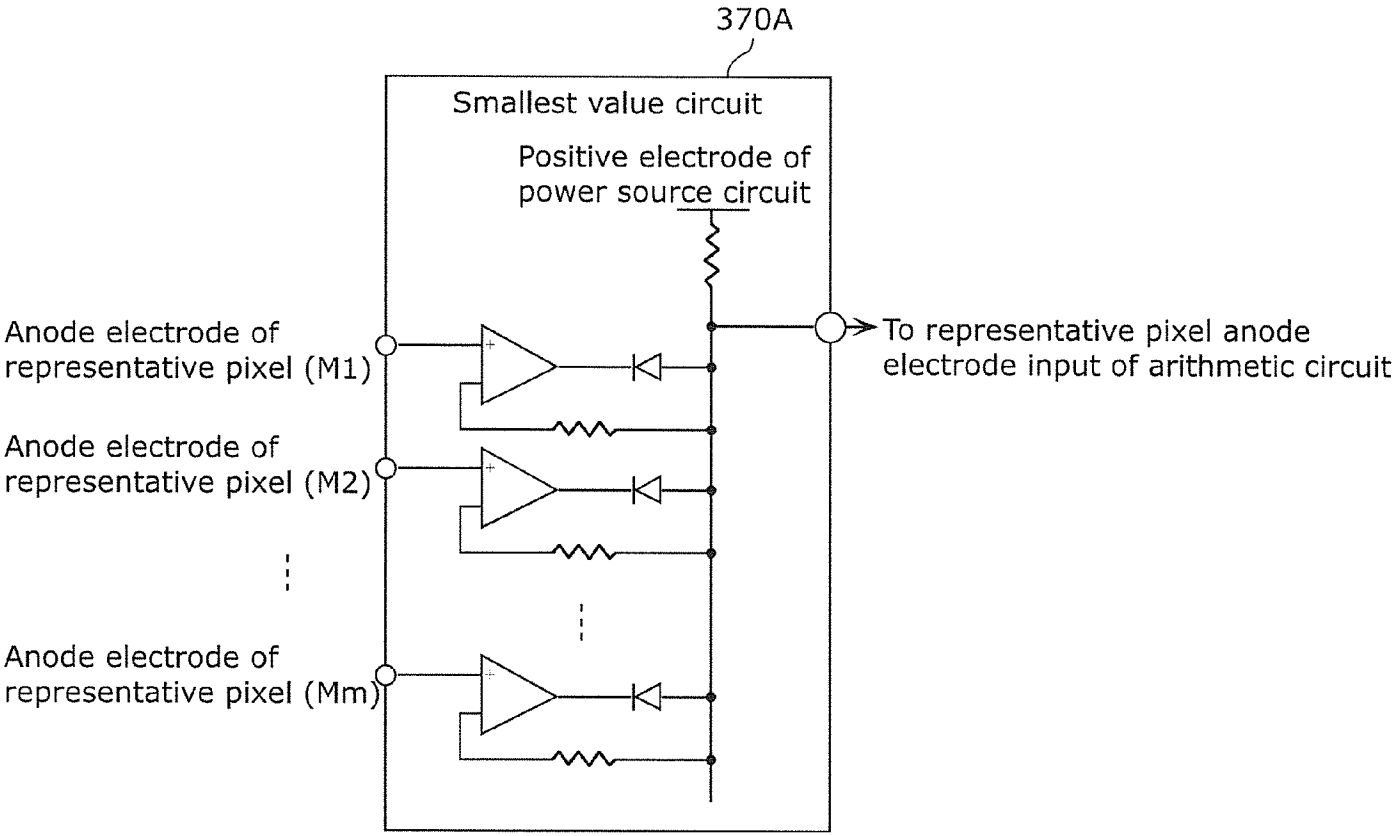
FIG. 16 is an example of a circuit diagram for a smallest value circuit according to Embodiment 2.

FIG. 16 is an example of a circuit diagram for a smallest value circuit according to Embodiment 2. The smallest value circuit 370A shown in the figure receives the inputs of the anode potentials of representative pixels M1 to Mm, and includes, for each of the anode potentials, a comparison circuit including an operational amplifier, a diode connected in series in a reverse-direction to the output direction of the operational amplifier, and a feedback resistor. With this circuit configuration, the smallest value circuit 370A outputs the smallest anode potential among the aforementioned anode potentials.

On the other hand, the largest value circuit 370B is part of a voltage measuring unit that measures the respective cathode potentials of the cathode detecting points N1 to N5 via the monitor wires 391B to 395B, respectively. The largest value circuit 370B detects the largest potential among the cathode potentials measured from the representative pixels, and outputs the detected largest potential to the arithmetic circuit 170.

Figure 17:
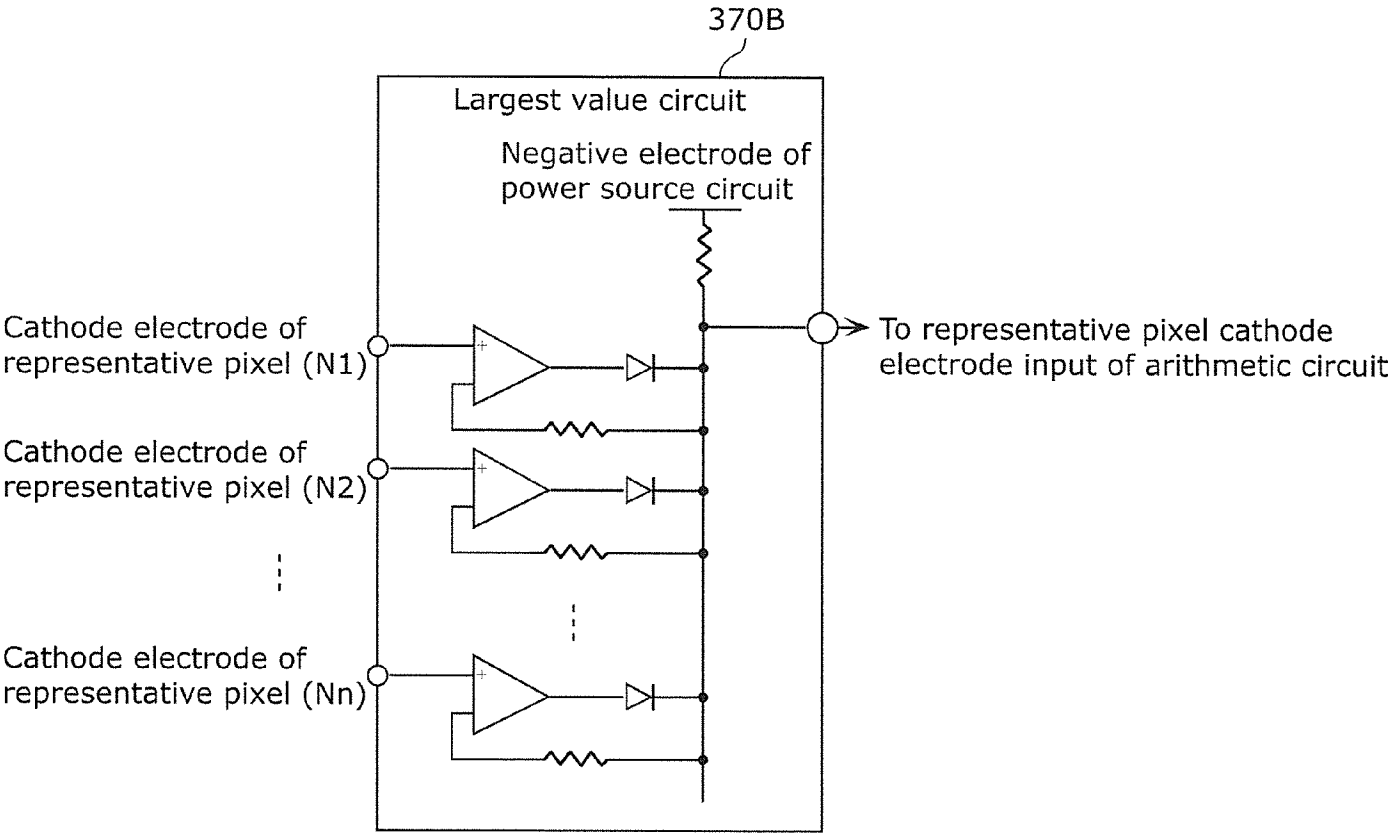
FIG. 17 is an example of a circuit diagram for a largest value circuit according to Embodiment 2.

FIG. 17 is an example of a circuit diagram for a largest value circuit according to Embodiment 2. The largest value circuit 370B shown in the figure receives the inputs of the cathode potentials of representative pixels N1 to Nm, and includes, for each of the cathode potentials, a comparison circuit including an operational amplifier, a diode connected in series in a forward direction to the output direction of the operational amplifier, and a feedback resistor. With this configuration, the largest value circuit 370B outputs the largest cathode potential among the aforementioned cathode potentials.

The arithmetic circuit 170 calculates the converted potential described in Embodiment 1 by assuming the aforementioned smallest potential as the anode potential of the representative pixels and the aforementioned largest potential as the cathode potential of the representative pixels.

Other than the arithmetic circuit 170, the configuration and the functions of the data line driving circuit 120, the write scan driving circuit 130, the control circuit 140, the peak signal detecting circuit 150, and the signal processing circuit 160 are the same as in the description given in Embodiment 1, and thus their description shall be omitted.

As described above, the display device 300 according to this embodiment supplies, to the organic EL display unit 310, an output voltage such that luminance deterioration does not occur in any of the representative pixels for monitoring. Specifically, by setting the output volume to a more appropriate value, power consumption is further reduced and deterioration of luminance in the respective pixels is suppressed. The advantageous effect thereof shall be described below using FIG. 18A to FIG. 19B.

Figure 18A:
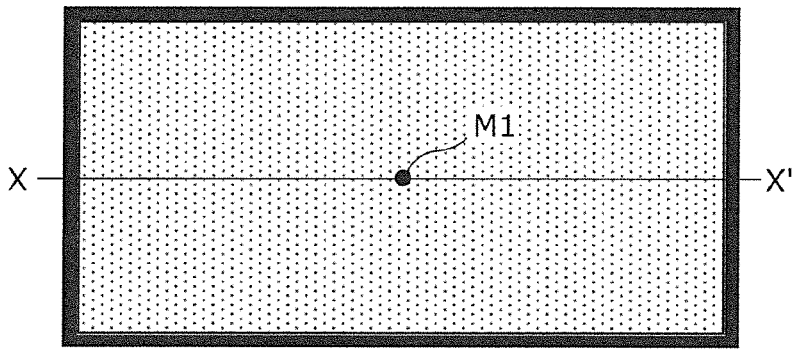
FIG. 18A is diagram schematically showing an example of an image displayed on the organic EL display unit.
Figure 18B:
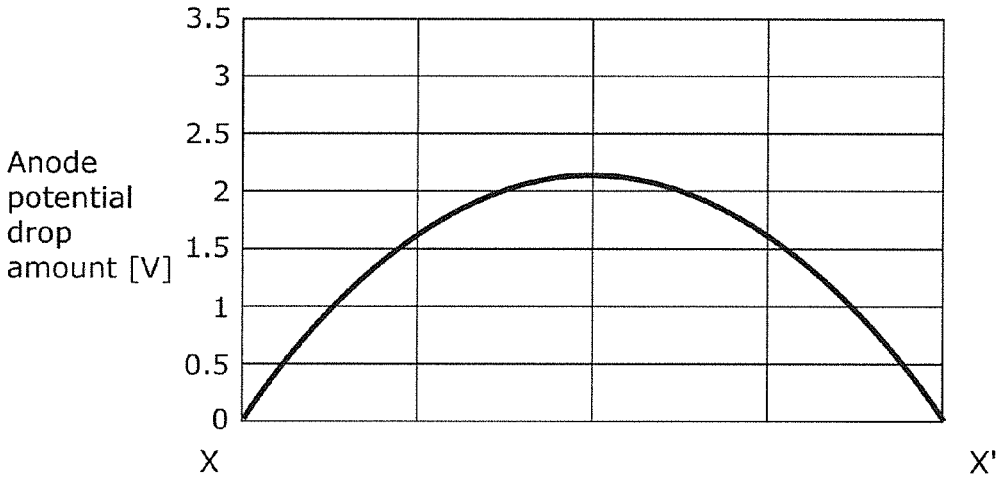
FIG. 18B is a graph showing a voltage drop amount for a first power source wire in line X-X' in the case of the image shown in FIG. 18A.
Figure 19A:
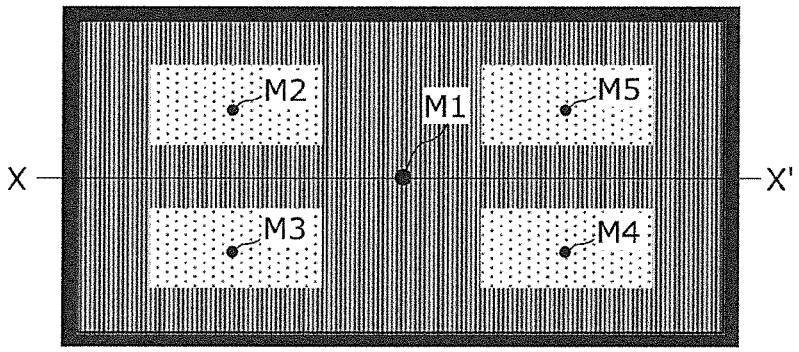
FIG. 19A is diagram schematically showing an example of an image displayed on the organic EL display unit.

FIG. 18A is a diagram schematically showing an example of an image displayed on the organic EL display unit, and FIG. 18B is a graph showing the potential drop amount for the first power source wire in line X-X' in the case of the image shown in FIG. 18A. FIG. 19A is a diagram schematically showing an example of an image displayed on the organic EL display unit, and FIG. 19B is a graph showing the potential drop amount for the first power source wire in line X-X' in the case of the image shown in FIG. 19A.

As shown in the FIG. 18A, when all of the pixels 111 of the organic EL display unit 310 produce luminescence at the same luminance, the anode potential drop amount for the first power source wire 112 is as shown in FIG. 18B. Furthermore, although not illustrated, the cathode potential rise amount for the second power source wire 113 has a different absolute value on the vertical axis as the anode potential value drop amount for the first power source wire 112 shown in FIG. 18B but has the same characteristics.

Therefore, by checking the potentials of the anode detecting point M1 and the cathode detecting point N1 which are at the center of the screen, it is possible to know the largest value of the voltage drop in the organic EL display unit. Specifically, when the potential of the anode detecting point M1 is Vp1 and the potential of the cathode detecting point N1 is Vn1, inputting the Vp1 and Vn1 to the arithmetic circuit 170 allows the converted potential to be fed back to the variable-voltage source 180, thus making it possible to cause all the pixels 111 inside the organic EL display unit 310 to produce luminescence at a precise luminance.

Figure 19B:
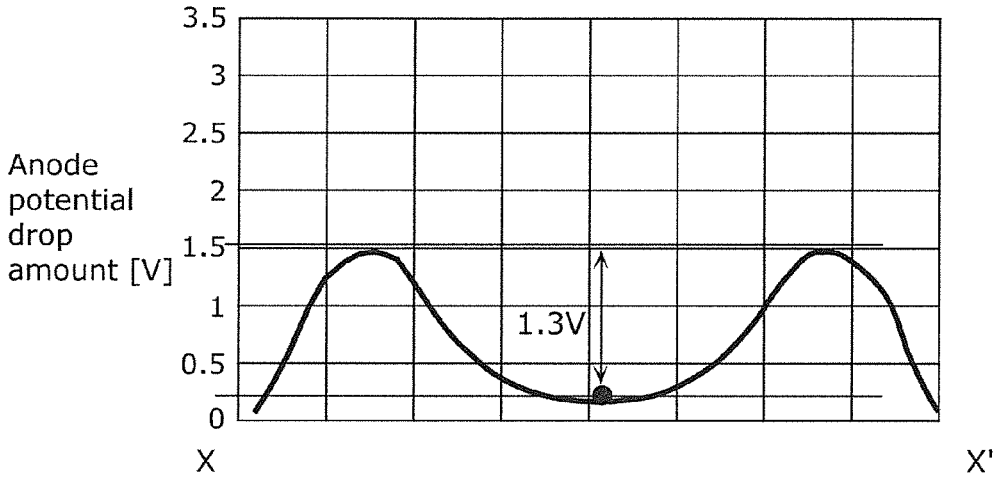
FIG. 19B is a graph showing a voltage drop amount for a first power source wire in line X-X' in the case of the image shown in FIG. 19A.

On the other hand, as shown in the FIG. 19A, when the pixels 111 at the central part of regions obtained when the screen is divided in two in the vertical direction and divided in two in the horizontal direction, that is, regions obtained by dividing the screen into four, produce luminescence at the same luminance and the other pixels 111 do not produce luminescence, the anode voltage drop amount for the first power source wire 112 is as shown in FIG. 19B. Furthermore, although not illustrated, the cathode potential rise amount for the second power source wire 113 has a different absolute value on the vertical axis as the anode potential value drop amount for the first power source wire 112 shown in FIG. 19B but has the same characteristics.

In this case, when measuring only the potential at the anode detecting point M1 and the cathode detecting point N1 which are at the center of the screen, it is necessary to set, as the positive electrode supply potential of the variable-voltage source 180, a potential obtained by adding a certain offset potential to the detected potential. For example, by setting, as the positive electrode supply potential of the variable-voltage source 180, a potential obtained by always adding a 1.3 V anode offset amount to the anode potential drop amount (0.2 V), at the center of the screen, for the first power source wire 112, and always adding a predetermined cathode offset amount to the cathode potential rise amount at the center of the screen shown in FIG. 19B, it is possible to cause all the pixels 111 inside the organic EL display unit 310 to produce luminescence at a precise luminance. Here, producing luminescence at a precise luminance means that the driving transistor 117 of the pixel 111 is operating in the saturation region.

However, in this case, since the anode offset amount and the cathode offset amount are always required for the positive electrode supply potential of the variable-voltage source 180, the power consumption reducing effect is lessened. For example, even in the case of an image in which the actual anode potential drop amount is 0.1 V, 0.1+1.3=1.4 V (when only the anode potential drop amount is considered) is set as the positive electrode supply potential of the variable-voltage source 180, and thus the output voltage increases by such amount, and the power consumption reducing effect is lessened.

In view of this, by adopting a configuration which divides the screen into four as shown in FIG. 19A and measures the potential at the five locations of the anode detecting points M1 to M5 and cathode detecting points N1 to N5 at the center of each of the four regions and the center of the entire screen, and not only the anode detecting point M1 and cathode detecting point N1 at the center of the screen, the accuracy of voltage drop amount detection can be enhanced. Therefore, it is possible to reduce the additional offset amount and increase the power consumption reducing effect.

For example, because the largest value for the potential drop amount shown in FIG. 19B is 1.5 V in the case where the potential drop amount at each of the detecting points M2 to M5 is 1.3 V, setting (in the case where only the anode potential drop is considered), as the positive electrode supply potential of the variable-voltage source 180, a voltage obtained by adding an offset of 0.2 V to the potential drop amount at each of the detecting points M2 to M5 makes it possible to cause all of the pixels 111 inside the organic EL display unit 310 to produce luminescence at a precise luminance.

In this case, even in the case of an image in which the actual voltage drop amount is 0.1 V, the value to be set as positive electrode supply potential of the variable-voltage source 180 is 0.1+0.2=0.3V, and thus 1.1 V of power source voltage can be further reduced compared to when only the potential at the detecting point M1 (and the cathode detecting point N1) at the center of the screen is measured.

As described above, compared to the display device 100, in the display devices 300 in this embodiment, there are many detecting points and the positive electrode supply potential of the variable-voltage source 180 can be regulated in accordance with the smallest value out of the measured anode potential drop amounts and the largest value out of the measured cathode potential drop amounts. Therefore, power consumption can be effectively reduced even when the size of the organic EL display unit 310 is increased.

It is to be noted that although one each of the smallest value circuit, largest value circuit, and arithmetic circuit are provided in the display device according to the present disclosure shown in FIG. 15, the display device according to Embodiment 2 of the present disclosure is not limited to the above-described configuration.

Figure 20:
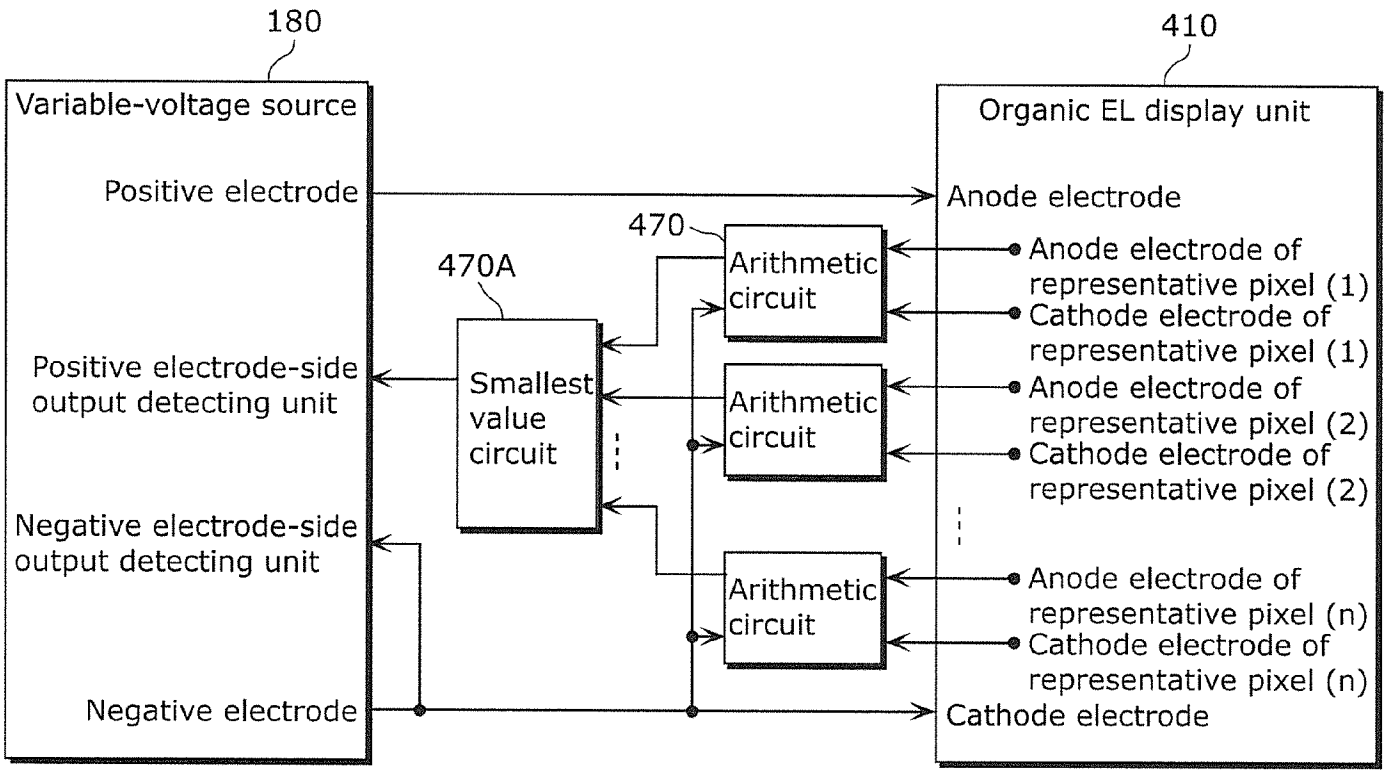
FIG. 20 is a block diagram of an arithmetic circuit and surrounding constituent elements representing a modification of Embodiment 2 of the present disclosure.

FIG. 20 is a block diagram of an arithmetic circuit and surrounding constituent elements representing a modification of Embodiment 2 of the present disclosure. In the display device shown in the figure, an arithmetic circuit 470 is provided for the pair of the anode potential and cathode potential that are measured for each of the plural representative pixels included in an organic EL display unit 410, the smallest converted potential out of the converted potentials outputted from the plural arithmetic circuits is detected by a smallest value circuit 470A, and the detected potential is outputted as, the converted potential, to the variable-voltage source 180. Even with this configuration, it is possible to produce the same advantageous effects as with the display device 300 shown in FIG. 14 and FIG. 15.

Although the display device according to the present disclosure has been described thus far based on the embodiments, the display device according to the present disclosure is not limited to the above-described embodiments. Modifications that can be obtained by executing various modifications to embodiments 1 and 2 that are conceivable to a person of ordinary skill in the art without departing from the essence of the present disclosure, and various devices in which the display device according to the present disclosure are provided therein are included in the present disclosure.

Furthermore, although the signal processing circuit 160 has the required voltage conversion table indicating the required voltage VTFT+VEL corresponding to the gradation levels of each color, the signal processing circuit may have, in place of the required voltage conversion table, the current-voltage characteristics of the driving transistor 117 and the current-voltage characteristics of the organic EL element 116, and determine VTFT+VEL by using these two current-voltage characteristics.

Figure 21:
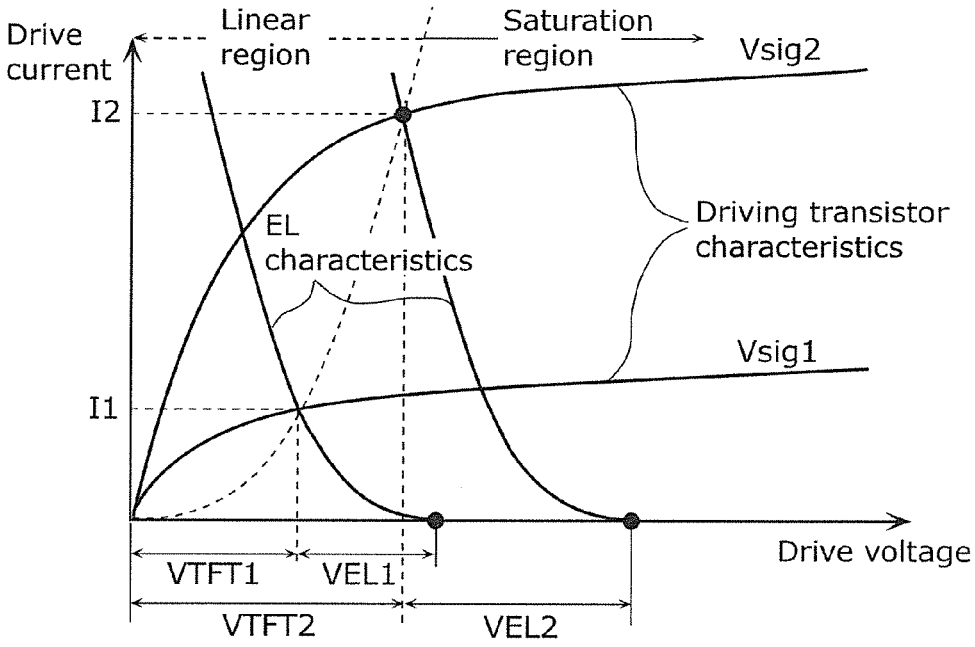
FIG. 21 is a graph showing together current-voltage characteristics of a driving transistor and current-voltage characteristics of an organic EL element.

FIG. 21 is a graph showing together current-voltage characteristics of the driving transistor and current-voltage characteristics of the organic EL element. In the horizontal axis, the direction of dropping with respect to the source potential of the driving transistor is the normal direction.

In the figure, current-voltage characteristics of the driving transistor and current-voltage characteristics of the organic EL element which correspond to two different gradation levels are shown, and the current-voltage characteristics of the driving transistor corresponding to a low gradation level is indicated by Vsig1 and the current-voltage characteristics of the driving transistor corresponding to a high gradation level is indicated by Vsig2.

In order to eliminate the impact of display defects caused by changes in the source-to-drain voltage of the driving transistor, it is necessary to cause the driving transistor to operate in the saturation region. On the other hand, the pixel luminescence of the organic EL element is determined according to the drive current. Therefore, in order to cause the organic EL element to produce luminescence precisely in accordance with the gradation level of video data, it is sufficient that the voltage remaining after the drive voltage (VEL) of the organic EL element corresponding to the drive current of the organic EL element is deducted from the voltage between the source electrode of the driving transistor and the cathode electrode of the organic EL element is a voltage that can cause the driving transistor to operate in the saturation region. Furthermore, in order to reduce power consumption, it is preferable that the drive voltage (VTFT) of the driving transistor be low.

Therefore, in FIG. 21, the organic EL element produces luminescence precisely in accordance with the gradation level of the video data and power consumption can be reduced most with the VTFT+VEL that is obtained through the characteristics passing the point of intersection of the current-voltage characteristics of the driving transistor and the current-voltage characteristics of the organic EL element on the line indicating the boundary between the linear region and the saturation region of the driving transistor.

In this manner, the required voltage VTFT+VEL corresponding to the gradation levels for each color may be calculated using the graph shown in FIG. 21.

Furthermore, the signal processing circuit 160 may change the first reference potential Vref1 on a plural frame (for example, a 3-frame) basis instead of changing the first reference potential Vref1 on a per frame basis.

With this, the power consumption occurring in the variable-voltage source 180 can be reduced by the fluctuation of the first reference potential Vref1.

Furthermore, although the required voltage VTFT+VEL corresponding to the gradation levels for each color is calculated on a per frame basis by the peak signal detecting circuit 150 and the signal processing circuit 160 in Embodiments 1 and 2, the required voltage may be a fixed preset voltage instead of being set on a per frame basis. Specifically, it is also acceptable to have a configuration in which the peak signal detecting circuit 150 is not provided and the first reference potential Vref1 is not supplied from the signal processing circuit 160 to the variable-voltage source 180, and whether or not the per-frame calculation of the above-described required voltage is performed is not an essential part of the present disclosure. In this case, a preset positive electrode potential and preset negative electrode potential in the variable-voltage source 180 do not change on a per frame basis depending on the video data. Even in this case, as long as the anode potential and cathode potential of the representative pixels are monitored and the respective arithmetic outputs thereof are fed back to the variable-voltage source such that the positive electrode supply potential of the variable-voltage source is adjusted accordingly, it is possible to reduce the impact of the voltage drop in the power source wire of the organic EL display unit and produce the advantageous effects of the present disclosure.

Furthermore, the signal processing circuits 160 may determine the required voltage with consideration being given to an aged deterioration margin for the organic EL element 116. For example, assuming that the aged deterioration margin for the organic EL element 116 is Vad, the signal processing circuit 160 may determine the required voltage to be VTFT+VEL+Vad.

Furthermore, although the switch transistor 119 and the driving transistor 117 are described as being P-type transistors in the above-described embodiments, they may be configured of N-type transistors.

Furthermore, although the switch transistor 119 and the driving transistor 117 are TFTs, they may be other field-effect transistors.

Furthermore, the respective processing units included in the display devices 100 and 300 according to the corresponding embodiments described earlier are typically implemented as an LSI which is an integrated circuit. It is to be noted that part of the processing units included in the display devices 100 and 300 can also be integrated in the same substrate as the organic EL display units 110 and 310. Furthermore, they may be implemented as a dedicated circuit or a general-purpose processor. Furthermore, a Field Programmable Gate Array (FPGA) which allows programming after LSI manufacturing or a reconfigurable processor which allows reconfiguration of the connections and settings of circuit cells inside the LSI may be used.

Furthermore, part of the functions of the data line driving circuit, the write scan driving circuit, the control circuit, the peak signal detecting circuit, the signal processing circuit, and the potential difference detecting circuit included in the display devices 100 and 300 according to the corresponding embodiments of the present disclosure may be implemented by having a processor such as a CPU execute a program. Furthermore, the present disclosure may also be implemented as a display device driving method including the characteristic steps implemented through the respective processing units included in the display devices 100 and 300.

Furthermore, although the foregoing descriptions exemplify the case where the display devices 100 and 300 are active-matrix organic EL display devices, the present disclosure may be applied to organic EL display devices other than that of the active-matrix type, and may be applied to a display device other than an organic EL display device using a current-driven luminescence element, such as a liquid crystal display device.

Figure 22:
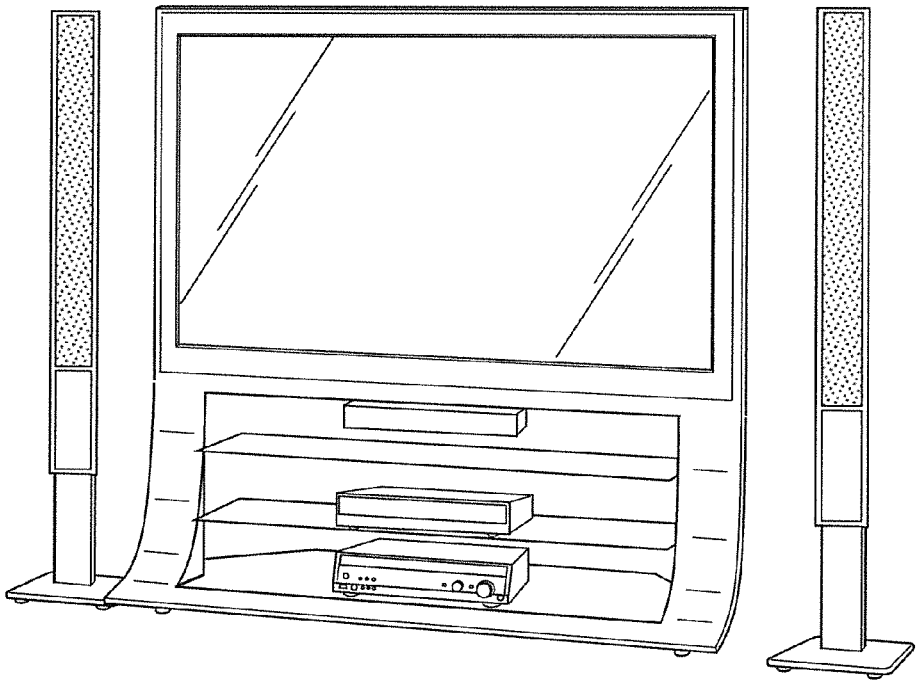
FIG. 22 is an external view of a thin flat-screen TV incorporating the display device according to the present disclosure.

Furthermore, for example, a display device according to the present disclosure is built into a thin flat-screen TV such as that shown in FIG. 22. A thin, flat TV capable of high-accuracy image display reflecting a video signal is implemented by having the display device according to the present disclosure built into the TV.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure is useful in an active-type organic EL flat panel display that requires driving with low power consumption.

The invention claimed is:

1. A display device comprising:

a display unit including a plurality of pixels each having an anode electrode and a cathode electrode;

a power supplying unit configured to supply a high-side potential and a low-side potential to the display unit;

a voltage measuring unit configured to measure an anode potential and a cathode potential of at least one representative pixel which is a predetermined one of the pixels; and an arithmetic circuit that calculates a voltage drop amount in the at least one representative pixel and feeds back the voltage drop amount to the power supplying unit, the voltage drop amount being an absolute value of a value obtained by subtracting the cathode potential corresponding to the low-side potential from the anode potential corresponding to a preset potential in a positive electrode of the power supplying unit, wherein the power supplying unit is configured to regulate the high-side potential with respect to the low-side potential, according to at least the anode potential and a potential difference between the low-side potential supplied by the power supplying unit to the display unit and the cathode potential of the at least one representative pixel measured by the voltage measuring unit, and supply the regulated high-side potential to the display unit, and the power supplying unit is configured to raise the high-side potential with respect to the low-side potential by a greater amount as the voltage drop amount is greater, and supply the raised high-side potential to the display unit.

2. The display device according to claim 1, further comprising:

a high-potential monitor wire having one end connected to the at least one representative pixel and an other end connected to the voltage measuring unit, for transmitting the anode potential; and a low-potential monitor wire having one end connected to the at least one representative pixel and an other end connected to the voltage measuring unit, for transmitting the cathode potential.

3. The display device according to claim 1, wherein the display unit includes:

two or more representative pixels from which anode potentials are measured, each of the representative pixels being the at least one representative pixel; and two or more representative pixels from which cathode potentials are measured, each of the representative pixels being the at least representative pixel, the voltage measuring unit includes:

a smallest value circuit that detects a smallest potential out of two or more anode potentials measured from the two or more representative pixels; and a largest value circuit that detects a largest potential out of two or more cathode potentials measured from the two or more representative pixels, and the arithmetic circuit calculates the voltage drop amount, using the smallest potential as the anode potential of the at least one representative pixel and the largest potential as the cathode potential of the at least one representative pixel.

4. The display device according to claim 1, wherein each of the pixels includes a driving element and a luminescence element, the driving element includes a source electrode and a drain electrode, the luminescence element includes a first electrode and a second electrode, the first electrode being connected to one of the source electrode and the drain electrode of the driving element, the anode potential is applied to one of the second electrode and the other of the source electrode and the drain electrode, and the cathode potential is applied to the other of the second electrode and the other of the source electrode and the drain electrode.

5. The display device according to claim 4, wherein the second electrode forms part of a common electrode provided in common to the pixels, the common electrode is electrically connected to the power supplying unit so that a potential is applied to the common electrode from a periphery of the common electrode, and the at least one representative pixel is disposed near a center of the display unit.

6. The display device according to claim 5, wherein the second electrode comprises a transparent conductive material including a metal oxide.

7. The display device according to claim 4, wherein the luminescence element is an organic electroluminescence (EL) element.

8. A display device comprising:

a display unit including a plurality of pixels each having an anode electrode and a cathode electrode;

a power supplying unit configured to supply a high-side potential and a low-side potential to the display unit;

a voltage measuring unit configured to measure an anode potential and a cathode potential of at least one representative pixel which is a predetermined one of the pixels; and an arithmetic circuit that calculates and outputs a converted potential which is a value obtained by adding-up the low-side potential and the anode potential and subtracting the cathode potential, wherein the power supplying unit is configured to regulate the high-side potential with respect to the low-side potential, according to at least the anode potential and a potential difference between the low-side potential supplied by the power supplying unit to the display unit and the cathode potential of the at least one representative pixel measured by the voltage measuring unit, and supply the regulated high-side potential to the display unit, and the power supplying unit is configured to compare the converted potential outputted from the arithmetic circuit and a preset potential in a positive electrode of the power supplying unit, raise the high-side potential with respect to the low-side potential by a greater amount as the converted potential is lower than the preset potential, and supply the raised high-side potential to the display unit.

9. The display device according to claim 8, wherein the display unit includes:

two or more representative pixels from which anode potentials are measured, each of the representative pixels being the at least one representative pixel; and two or more representative pixels from which cathode potentials are measured, each of the representative pixels being the at least one representative pixel, the voltage measuring unit includes:

a smallest value circuit that detects a smallest potential out of two or more anode potentials measured from the two or more representative pixels; and a largest value circuit that detects a largest potential out of two or more cathode potentials measured from the two or more representative pixels, and the arithmetic circuit calculates the converted potential, using the smallest potential as the anode potential of the at least one representative pixel and the largest potential as the cathode potential of the at least one representative pixel.

10. The display device according to claim 8, wherein the display unit includes a plurality of representative pixels from which anode potentials and cathode potentials are measured, each of the representative pixels being the at least one representative pixel, the display device further comprises a plurality of arithmetic circuits that calculate and output converted potentials for the respective representative pixels, each of the arithmetic circuits being the arithmetic circuit, and the power supplying unit is configured to compare the preset potential and a smallest converted potential among the converted potentials outputted from the arithmetic circuits, raise the high-side potential with respect to the low-side potential by a greater amount as the smallest converted potential is lower than the preset potential, and output the raised high-side potential to the display unit.

11. A display device driving method for driving a display device including a power supplying unit that supplies a high-side potential and a low-side potential to a display unit including a pixel having an anode electrode and a cathode electrode, the method comprising:

measuring a cathode potential of the pixel; and causing the power supplying unit to supply, to the display unit, the high-side potential with respect to the low-side potential, according to a potential difference between at least the low-side potential supplied by the power supplying unit to the display unit and the cathode potential measured in the measuring, wherein the power supplying unit is caused to raise the high-side potential with respect to the low-side potential by a greater amount as an amount of voltage rise occurring in a cathode power source wire increases, and supply the raised high-side potential to the display unit.

12. The display device driving method according to claim 11, wherein the display unit includes a plurality of pixels each of which is the pixel;

in the measuring, a cathode potential of at least one representative pixel is measured, the at least one representative pixel being a predetermined one of the pixels, and in the causing, the power supplying unit is caused to supply, to the display unit, the high-side potential with respect to the low-side potential, according to a potential difference between at least the low-side potential supplied by the power supplying unit to the display unit and the cathode potential of the at least one representative pixel measured in the measuring.

13. The display device driving method according to claim 12, wherein in voltage measuring, an anode potential and the cathode potential of the at least one representative pixel are measured, and in the causing, the power supplying unit is caused to supply, to the display unit, the high-side potential with respect to the low-side potential, according to the anode potential and the potential difference between the low-side potential and the cathode potential.

* * * * *